US007371102B2

(12) United States Patent
Sakamoto et al.

(10) Patent No.: US 7,371,102 B2
(45) Date of Patent: May 13, 2008

(54) LOCK STRUCTURE OF CONNECTOR

(75) Inventors: Nobuyuki Sakamoto, Haibara-gun (JP); Shigeru Tanaka, Haibara-gun (JP); Hiroshi Nakamura, Haibara-gun (JP); Makoto Yamanashi, Haibara-gun (JP); Atsushi Nishida, Toyota (JP); Masato Minakata, Toyota (JP); Hiroshi Kobayashi, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/178,591

(22) Filed: Jul. 12, 2005

(65) Prior Publication Data

US 2006/0014414 A1 Jan. 19, 2006

(30) Foreign Application Priority Data

Jul. 12, 2004 (JP) ..... P. 2004-204891

(51) Int. Cl.
*H01R 13/627* (2006.01)

(52) U.S. Cl. ..... 439/352; 439/489; 439/357

(58) Field of Classification Search ..... 439/352, 439/354, 357, 358, 488, 489
See application file for complete search history.

(56) References Cited

U.S. PATENT DOCUMENTS 5,791,930 A * 8/1998 Tabata et al. ..... 439/345
5,938,470 A * 8/1999 Kashiyama ..... 439/489
6,224,414 B1 * 5/2001 Fukuda ..... 439/352
6,341,974 B1 * 1/2002 Konoya ..... 439/352
6,454,590 B1 * 9/2002 Goodrich et al. ..... 439/357
6,475,014 B2 * 11/2002 Tsuji et al. ..... 439/352
6,821,135 B1 * 11/2004 Martin ..... 439/144

FOREIGN PATENT DOCUMENTS

JP 11-40266 A 2/1999

* cited by examiner

*Primary Examiner*—Hien Vu
(74) *Attorney, Agent, or Firm*—Sughrue Mion, PLLC

(57) ABSTRACT

In a connector lock structure 1 provided at female and male connectors which can be fitted together, the female connector 2 has an engagement portion 14, and a slide lock member 13 is supported on the male connector 3 so as to move at least in connector-inserting and connector-withdrawing directions. The slide lock member 13 includes a retaining portion 16 for engagement with the engagement portion 14, and urging member 36 for urging the slide lock member 13. When the engagement portion 14 reaches an engagement position where it is engaged with the retaining portion 16 at the time when the female and male connectors are completely fitted together, the slide lock member 13 is automatically moved by the urging member 36, so that the retaining portion 16 is engaged with the engagement portion 14.

6 Claims, 23 Drawing Sheets

LOCK STRUCTURE OF CONNECTOR

BACKGROUND OF THE INVENTION

1. Field of the Invention

This invention relates to a connector lock structure for a pair of female and male connectors which can be fitted together so that connection terminals in one of the two connectors are electrically connected respectively to the connection terminals in the other connector.

2. Related Art

There is shown one conventional connector lock structure in which engagement projections are formed on a wire harness-side male connector housing, and passage grooves for the passage of the engagement projections of the male connector housing therethrough are formed in a hood portion of an equipment-side (board-side) female connector housing relative to which the male connector housing can be inserted and withdrawn, and a slide member can be moved in a direction perpendicular to a connector inserting/withdrawing direction (that is, a connector inserting direction and a connector withdrawing direction) by pressing an operating portion, and the slide member has elastic retaining projections which can be engaged with the engagement projections at a position disposed rearwardly of the passage grooves in the connector inserting direction.

In such a connector lock structure, the slide member is operated or pressed, and at the time when the female and male connector housings are fitted together, the retaining projections of a lock arm are engaged respectively with the engagement projections of the male connector housing, thereby achieving a locked condition. By moving the slide member in a direction opposite to the locking direction by an amount corresponding to a width of one engagement projection, the locked condition is canceled.

However, in the connector lock structure disclosed in Unexamined Japanese Patent Publication JP-A-11-040266, not only when the male connector housing is to be inserted into the female connector housing but also when the former is to be withdrawn from the latter, it is necessary to press the slide member in the direction perpendicular to the connector inserting/withdrawing direction so as to effect the locking operation and the unlocking operation. In recent years, the slide member has inevitably been formed into a small size because of a demand for a compact design of the connector, and therefore it has been difficult to secure the satisfactory operability of the slide member. Particularly, the operation (in which simultaneously when moving the male connector housing in the connector inserting/withdrawing direction, the slide member is moved independently in the direction perpendicular to the connector inserting/withdrawing direction) makes the pressing operation of the slide member complicated, and this has been a cause for a hindrance to the positive locking and unlocking operations.

SUMMARY OF THE INVENTION

This invention has been made in view of the above problem, and an object of the invention is to provide a connector lock structure which though having a compact outer size, can easily and positively effect a locking operation and an unlocking operation.

The above object has been achieved by the present invention having features recited as follows:

A connector lock structure provided at a pair of female and male connectors which can be fitted together, comprising:

one of the female and male connectors having an engagement portion; and a slide lock member supported on the other of the female and male connectors so as to move at least in connector-inserting and connector-withdrawing directions; and the slide lock member including a retaining portion for engagement with the engagement portion, and urging member for urging the slide lock member;

wherein when the engagement portion reaches an engagement position where the engagement portion is engaged with the retaining portion at the time when the female and male connectors are completely fitted together, the slide lock member is automatically moved by the urging member, so that the retaining portion is engaged with the engagement portion.

In the connector lock structure of the above construction, when one of the female and male connectors is inserted into the other, the locking of the female and male connectors to each other can be automatically completed without the need for operating the slide lock member at all. Therefore, even when the female and male connectors are compact in size, the locked condition of the female and male connectors can be easily and positively obtained.

A connector lock structure described above, wherein the engagement of the retaining portion with the engagement portion is canceled by operating the slide lock member in one of the connector-inserting and connector-withdrawing directions.

In the connector lock structure of the above construction, the connector withdrawing direction is parallel to the direction of operating of the slide lock member, and the operability of the slide lock member for canceling the engagement of the retaining portion with the engagement portion can be enhanced. Therefore, even when the female and male connectors are compact in size, the operation for unlocking the female and male connectors relative to each other can be easily carried out.

A connector lock structure described above, wherein the urging member includes an elastic member; and as the female and male connectors are moved relative to each other so as to be fitted together, the engagement portion and the retaining portion are brought into abutting engagement with each other, so that the slide lock member is moved while elastically deforming the elastic member.

In the connector lock structure of the above construction, when the engagement portion reaches the engagement position where it is engaged with the retaining portion, the elastic member is already elastically deformed, a restoring action of the elastic member produces an urging force for return the slide lock member back. As a result, the locking operation for the female and male connectors can be automatically completed, and besides the operation for engaging the engagement portion and the retaining portion with each other is clearly carried out in a snap-action manner, and therefore a half-fitted condition of the female and male connectors can be detected. Therefore, even when the female and male connectors are compact in size, the locked condition of the female and male connectors can be easily and positively obtained.

A connector lock structure described above, wherein the male connector includes a male connector housing receiving at least one first terminal of one of a male terminal type and a female terminal type; and the slide lock member is mounted on an outer surface of the male connector housing; and the female connector includes a female connector housing receiving at least one second terminal of the other of the male terminal type and the female terminal type for electrical connection to the first terminal; and the female connector housing includes a hood portion surrounding the second terminal, and the male connector housing can be inserted into and withdrawn from the hood portion; and the engagement portion is formed in a projecting manner within the hood portion.

In the connector lock structure of the above construction, the engagement portion and the retaining portion are disposed between the hood portion of the female connector housing and the outer surface of the male connector housing, and will not be exposed to the exterior when the female and male connectors are fitted together. Therefore, the engagement of the retaining portion and the engagement portion with each other is prevented from being accidentally canceled upon application of an impact or the like from the exterior.

A connector lock structure described above, wherein the retaining portion includes a pair of retaining piece portions which are spaced a predetermined distance from each other, and extend in the connector inserting direction in parallel relation to each other, and the distance between distal end portions of the pair of retaining piece portions is reduced; and as the female and male connectors are moved relative to each other so as to be fitted together, the engagement portion is inserted between the distal end portions of the pair of retaining piece portions to increase the distance between the distal end portions, and reaches the engagement position; and the slide lock member is moved in the connector inserting direction by the urging member, so that the engagement portion is received between the pair of retaining piece portions.

In the connector lock structure of the above construction, the engagement portion is inserted between the distal end portions of the pair of retaining piece portions extending in the connector inserting direction, and the slide lock member is moved in the connector inserting direction by the urging member, so that the engagement portion is received between the pair of retaining piece portions, and the distal end portions of the retaining piece portions are engaged with the engagement portion. Therefore, in the series of operations for inserting the male connector housing into the female connector housing, the locking operation for the female and male connectors can be automatically carried out. And besides, by operating the slide lock member in the connector withdrawing direction, the distal end portions of the pair of retaining piece portions are brought into abutting engagement with the engagement portion, so that the distance between these distal end portions is increased, thereby canceling the engagement of the retaining portion with the engagement portion. Thus, the connector withdrawing direction coincides with the direction of operating of the slide lock member, and therefore the operability of the slide lock member can be enhanced.

A connector lock structure described above, wherein when the slide lock member is moved by the urging member, the distal end portions of the pair of retaining piece portions are moved toward each other.

In the connector lock structure of the above construction, the distance between the distal end portions of the pair of retaining piece portions is further reduced, and therefore the engagement portion is prevented from being accidentally withdrawn from between the pair of retaining piece portions. Therefore, the engagement portion and the retaining portion can be more positively engaged with each other, thereby increasing the strength of locking of the female and male connectors. A projecting piece portion can be formed at one end of the engagement portion, in which case this projecting piece portion is interposed between the distal end portions of the retaining piece portions, and is held therebetween. With this construction, the engagement portion and the retaining portion can be still more positively engaged with each other, thereby further increasing the strength of locking of the female and male connectors.

A connector lock structure described above, wherein the retaining portion includes a retaining frame for receiving the engagement portion; and as the female and male connectors are moved relative to each other so as to be fitted together, the engagement portion, while moving the slide lock member into a position below the engagement portion, reaches the engagement position; and simultaneously when the slide lock member is moved in the connector inserting direction by the urging member, the slide lock member is also moved upward, so that the engagement portion is received within the retaining frame.

In the connector lock structure of the above construction, the engagement portion, while moving the slide lock member into the position below the engagement portion, reaches the engagement position, and simultaneously when the slide lock member is moved in the connector inserting direction by the urging member, the slide lock member is also moved upward, so that the engagement portion is received within the retaining frame. Therefore, in the series of operations for inserting the male connector housing into the female connector housing, the locking operation for the female and male connectors can be automatically carried out. And besides, the slide lock member is operated in the connector withdrawing direction simultaneously when the slide lock member is pressed to be moved downward, and by doing so, the engagement portion is disengaged from the retaining frame, thereby canceling the engagement of the retaining portion with the engagement portion. Thus, the connector withdrawing direction coincides with the direction of operating of the slide lock member, and therefore the operability of the slide lock member can be enhanced. Furthermore, because of the shape of the retaining frame for receiving the engagement portion, there is no fear that this retaining frame is deformed, and therefore the engagement portion and the retaining portion can be more positively engaged with each other, thereby increasing the strength of locking of the female and male connectors.

A connector lock structure described above, wherein the male connector housing has a convex portion which is disposed forwardly of the slide lock member in the connector inserting direction; and as the female and male connectors are moved relative to each other so as to be fitted together, the engagement portion slides over the convex portion to reach the engagement position; and the slide lock member is moved in the connector inserting direction by the urging member, so that the retaining portion is superposed on the engagement portion.

In the connector lock structure of the above construction, after the engagement portion slides over the convex portion to reach the engagement position, the slide lock member is moved in the connector inserting direction by the urging member, so that the retaining portion is superposed on the engagement portion. Therefore, the engagement portion is prevented from moving upward, and can not slide onto the convex portion, so that the female and male connectors are locked to each other. When the slide lock member is operated in the connector withdrawing direction, the retaining portion is moved from the position where the retaining portion is superposed on the engagement portion, and therefore the engagement portion is allowed to move upward, and can slide onto the convex portion, and the female and male connectors can be unlocked relative to each other. Therefore, in the series of operations for inserting the male connector housing into the female connector housing, the locking operation for the female and male connectors can be automatically carried out. And besides, the connector withdrawing direction coincides with the direction of operating of the slide lock member, and therefore the operability of the slide lock member can be enhanced.

In the connector lock structure of the present invention, when one of the female and male connectors is inserted into the other, the locking of the female and male connectors to each other can be automatically completed without the need for operating the slide lock member at all. Therefore, even when the female and male connectors are compact in size, the locked condition of the female and male connectors can be easily and positively obtained. And besides, the connector withdrawing direction is parallel to the direction of operating of the slide lock member, and therefore the operability of the slide lock member for canceling the engagement of the retaining portion with the engagement portion can be enhanced. Therefore, the connector lock structure, though having the compact outer size, can easily and positively effect the locking operation and unlocking operation for the female and male connectors.

DETAILED DESCRIPTION OF THE PREFERRED EMBODIMENTS

Figure 1:
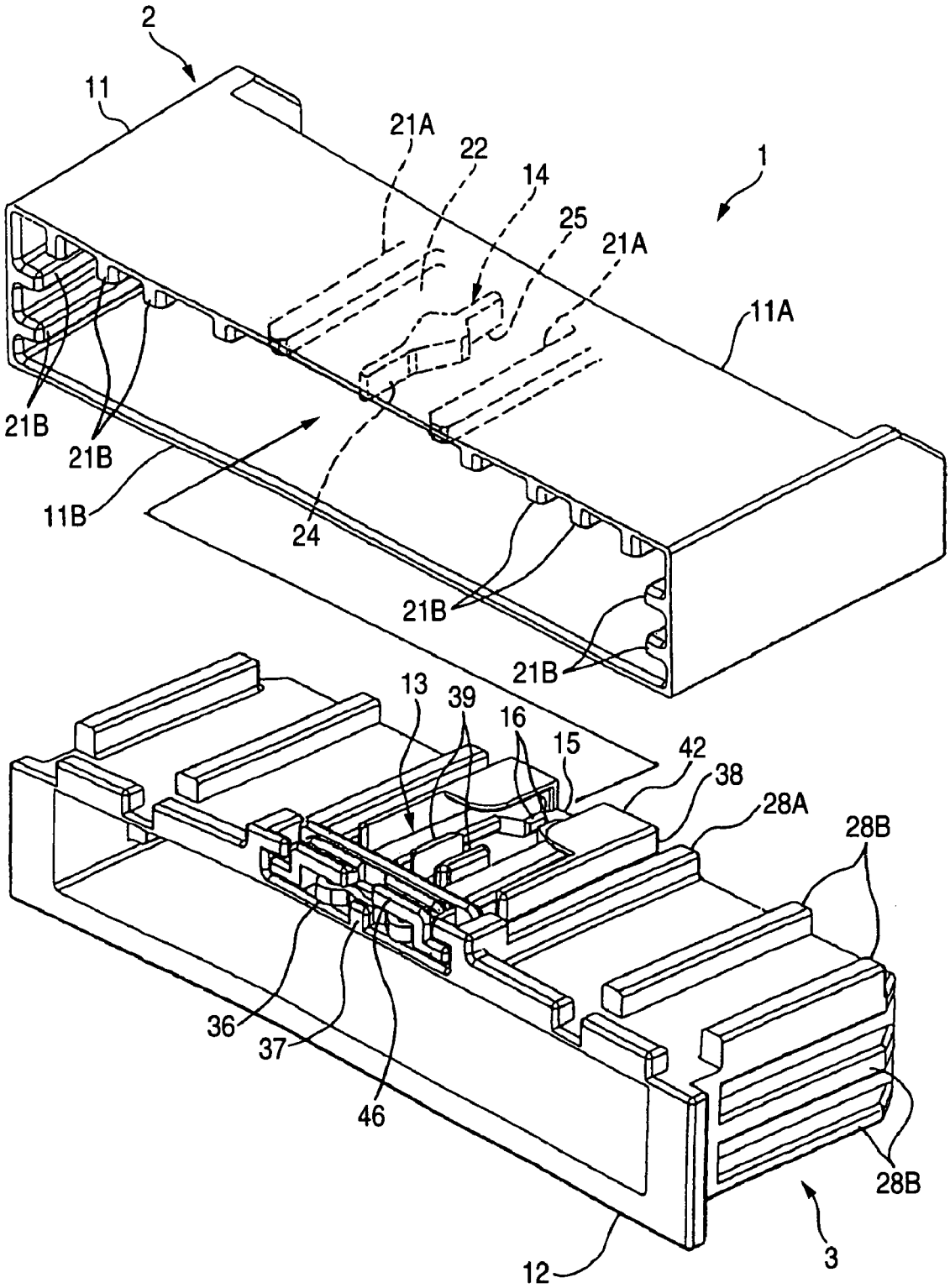
FIG. 1 is a perspective view of a first embodiment of a connector lock structure of the present invention.
Figure 2:
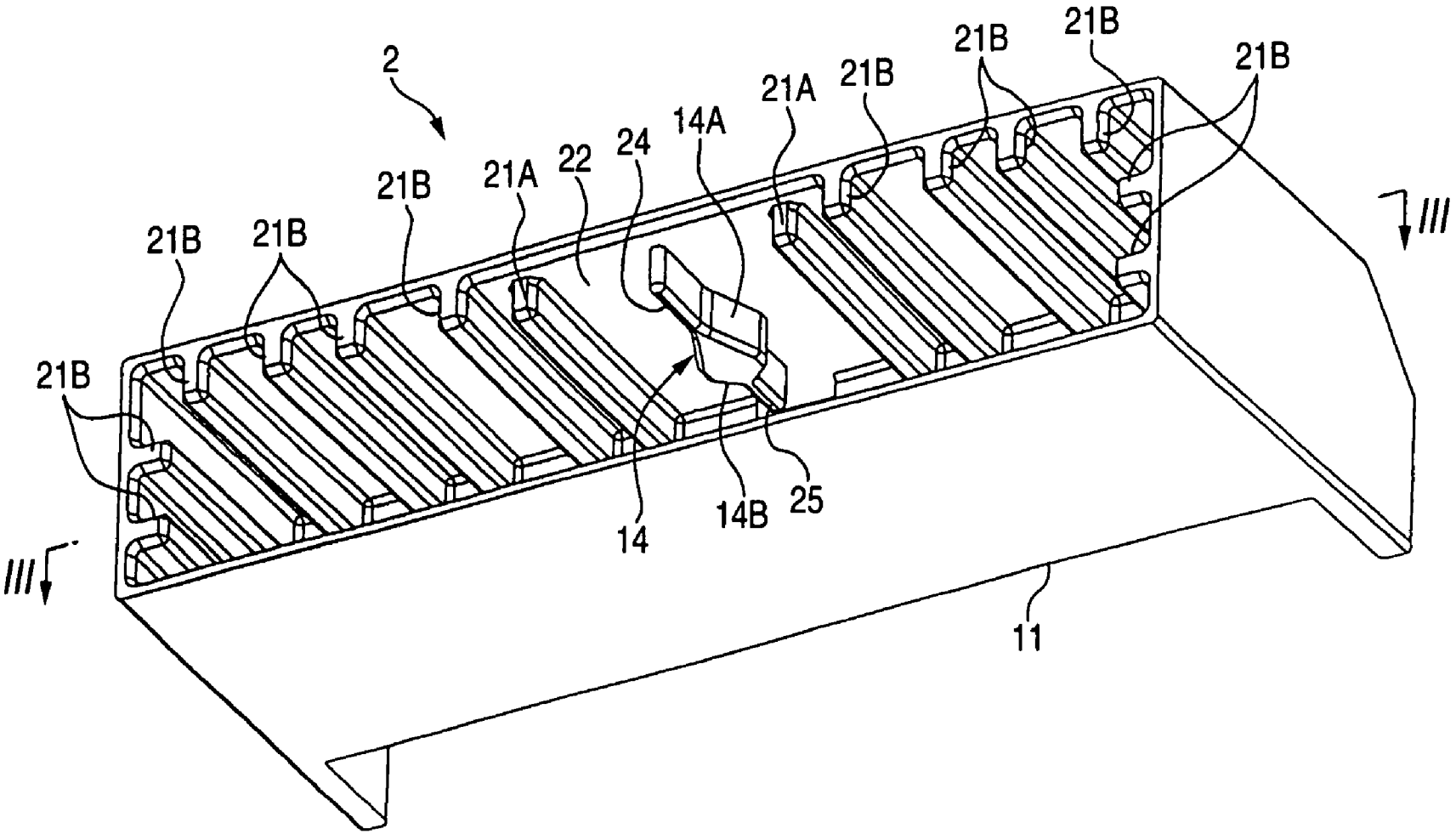
FIG. 2 is a perspective view showing a female connector housing of FIG. 1 alone.
Figure 3:
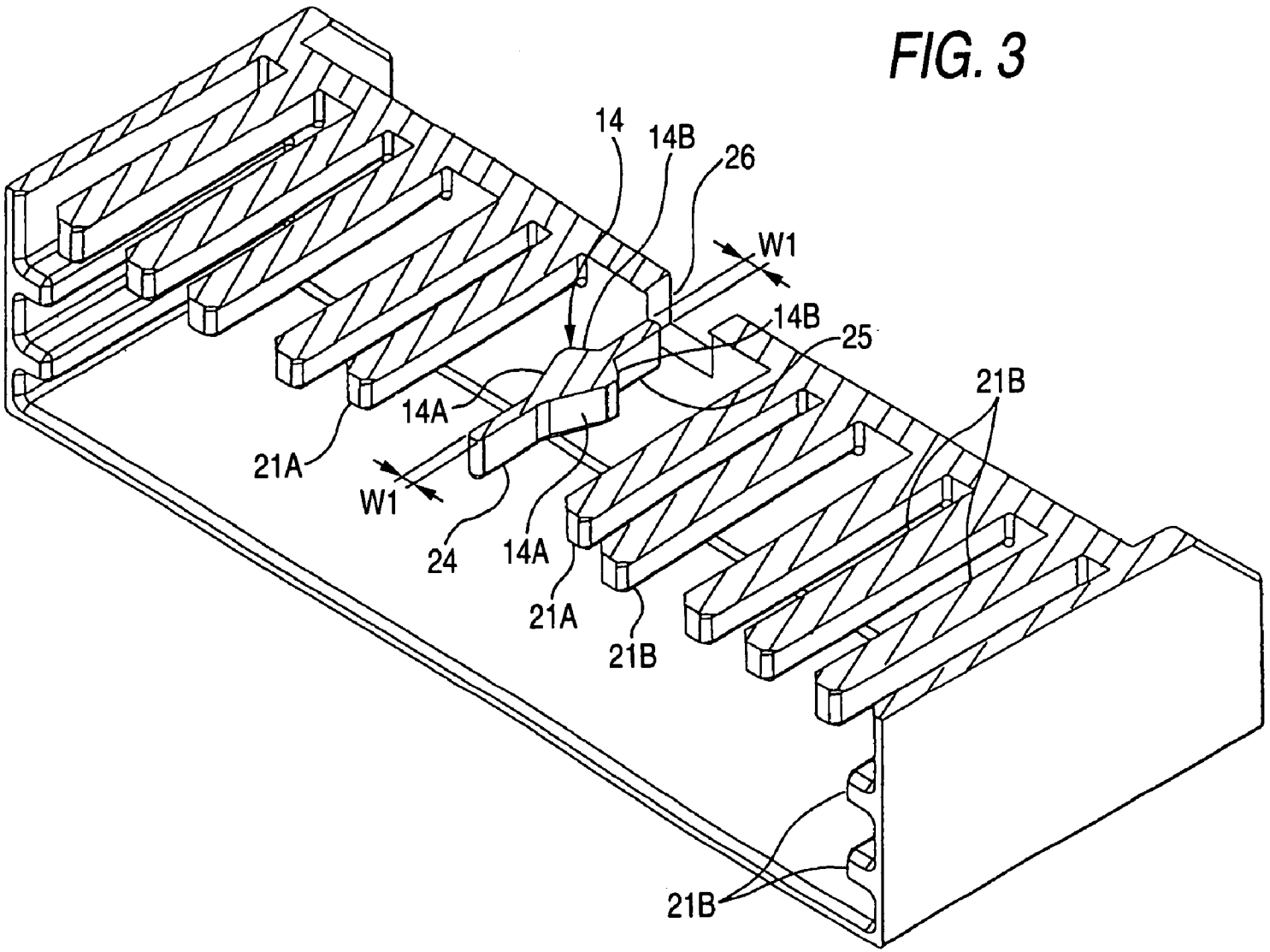
FIG. 3 is a cross-sectional view taken along the line III-III of FIG. 2.
Figure 4:
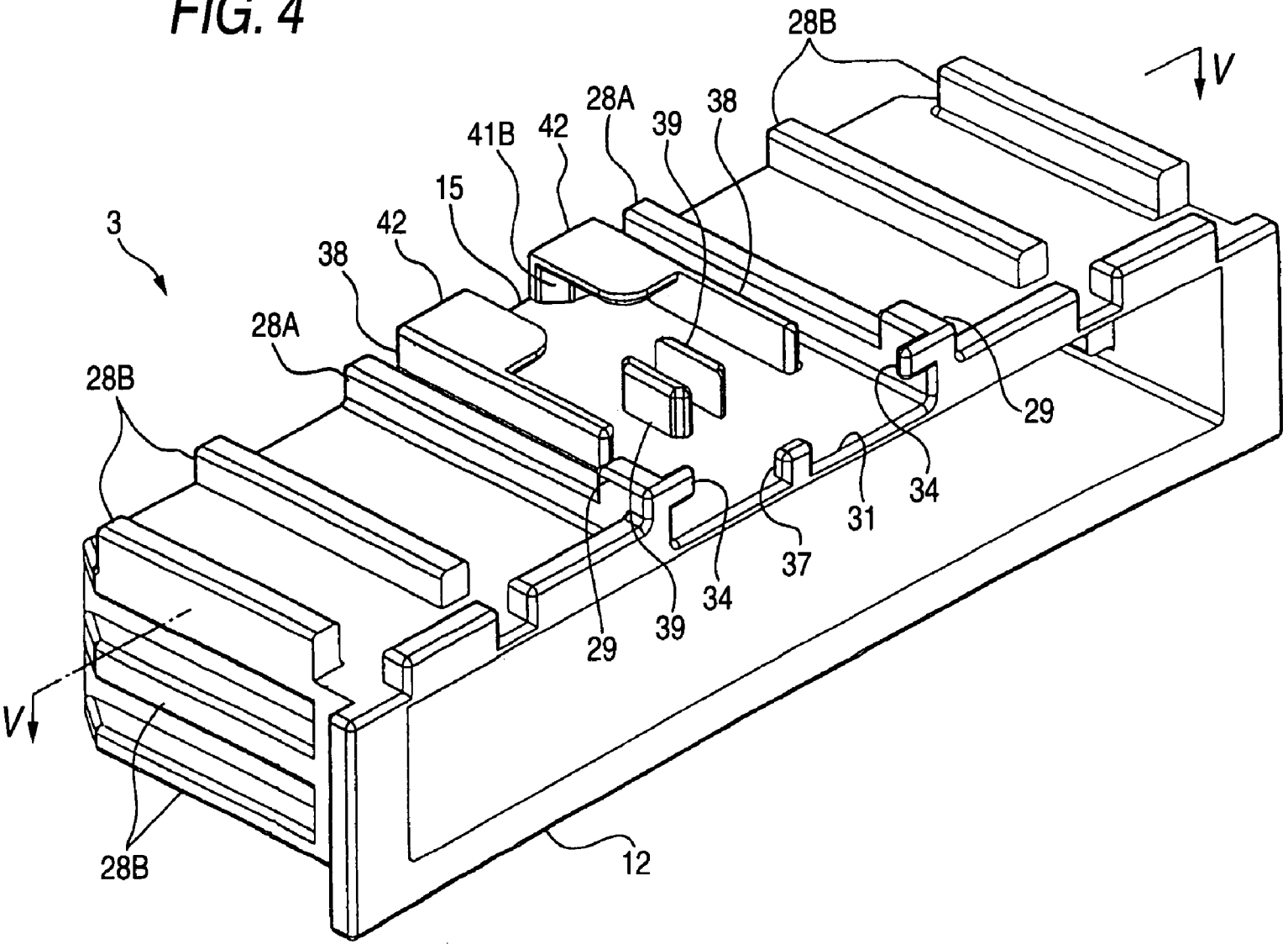
FIG. 4 is a perspective view showing a male connector housing of FIG. 1 alone.
Figure 5:
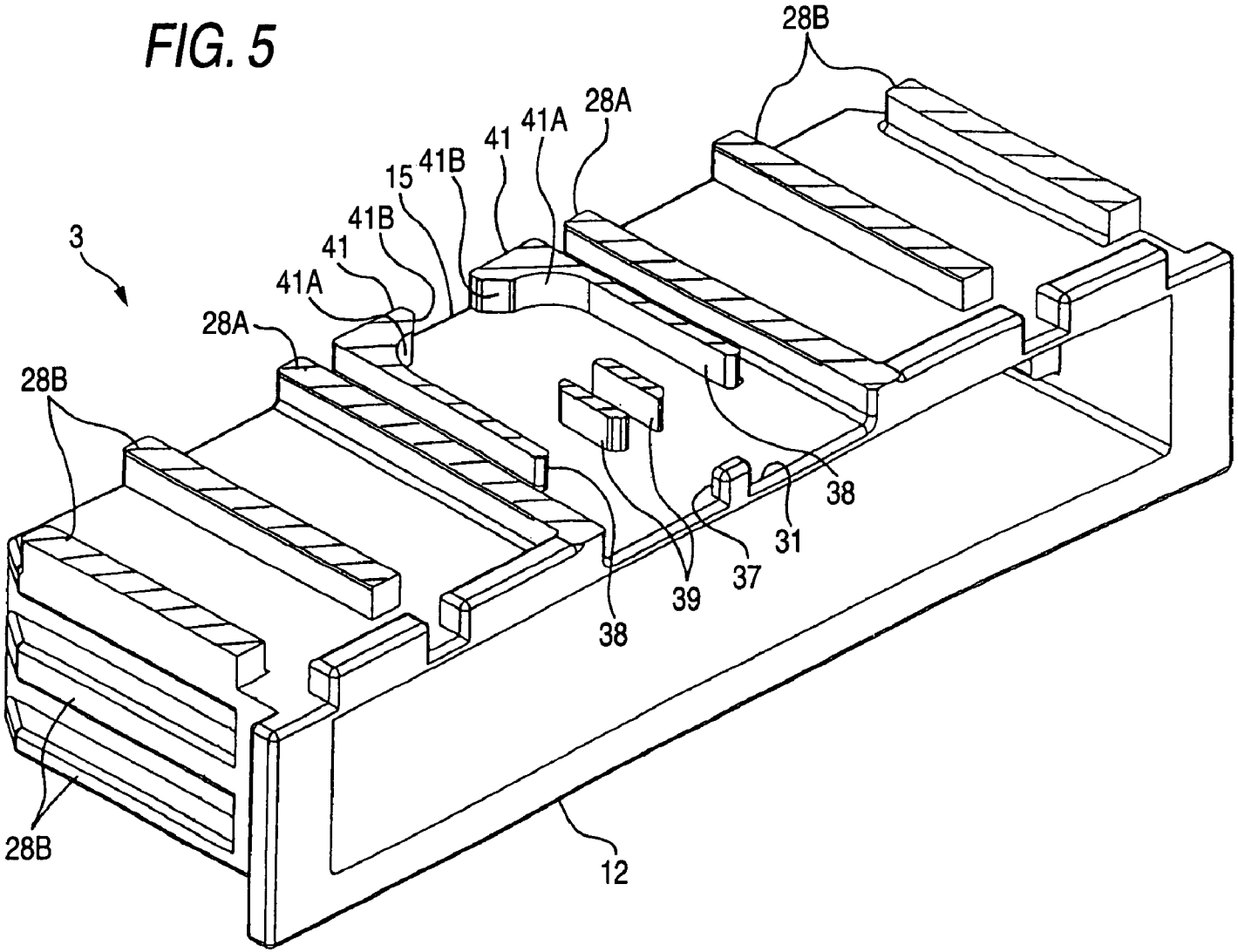
FIG. 5 is a cross-sectional view taken along the line V-V of FIG. 4.
Figure 6:
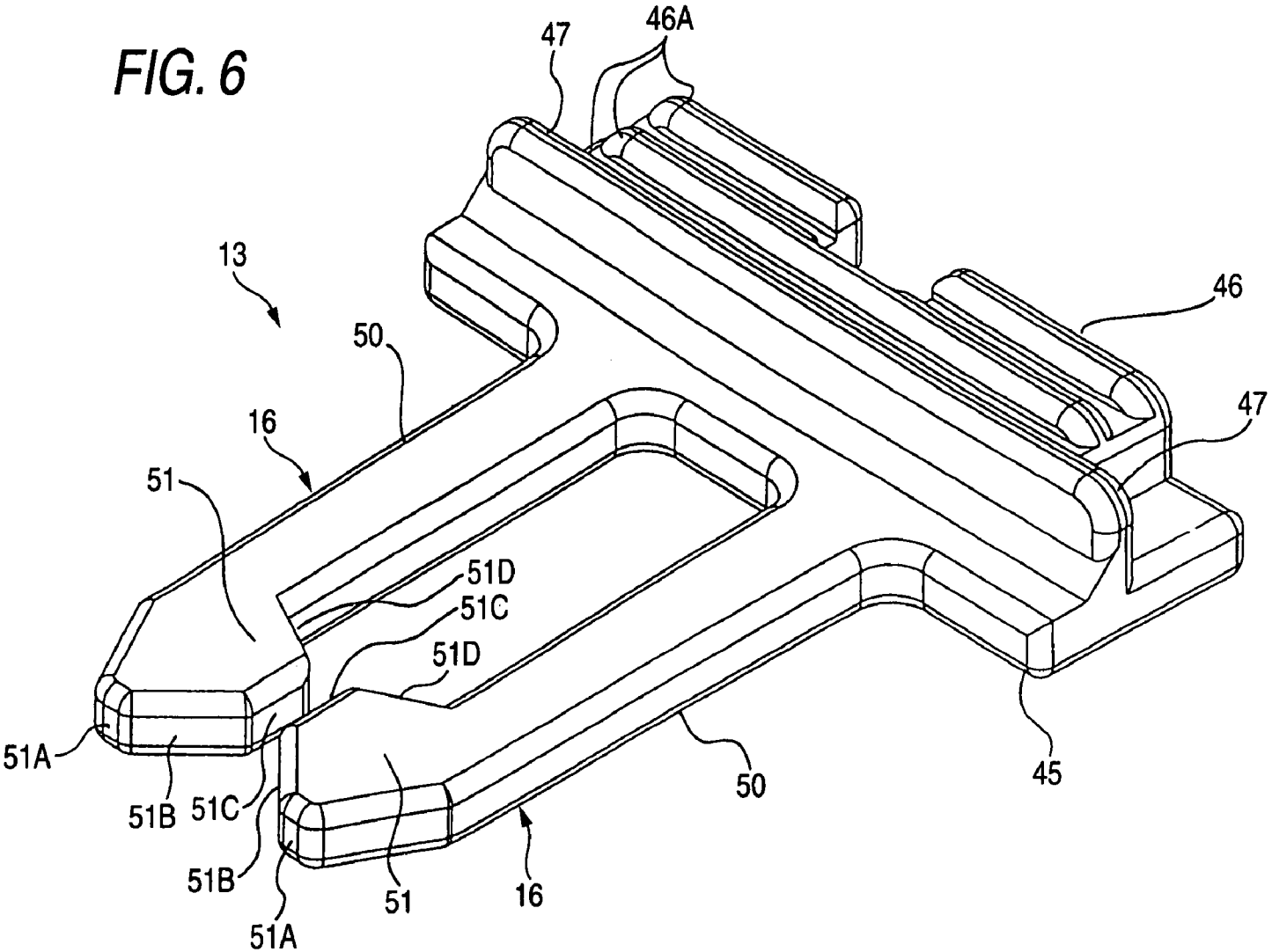
FIG. 6 is a perspective view showing a slide lock member of FIG. 1 alone.
Figure 7:
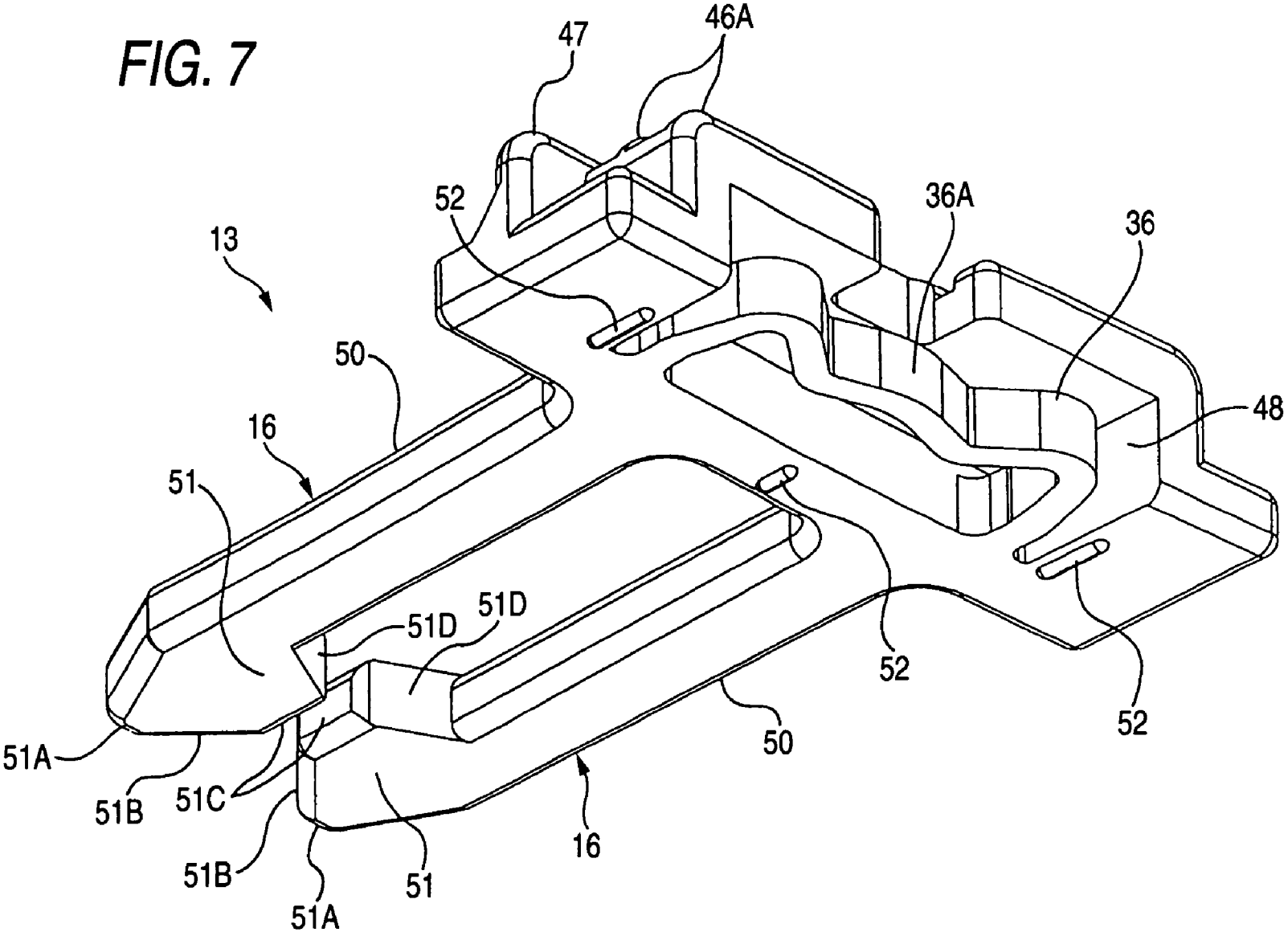
FIG. 7 is a perspective view of the slide lock member of FIG. 6, showing its rear side.
Figure 8:
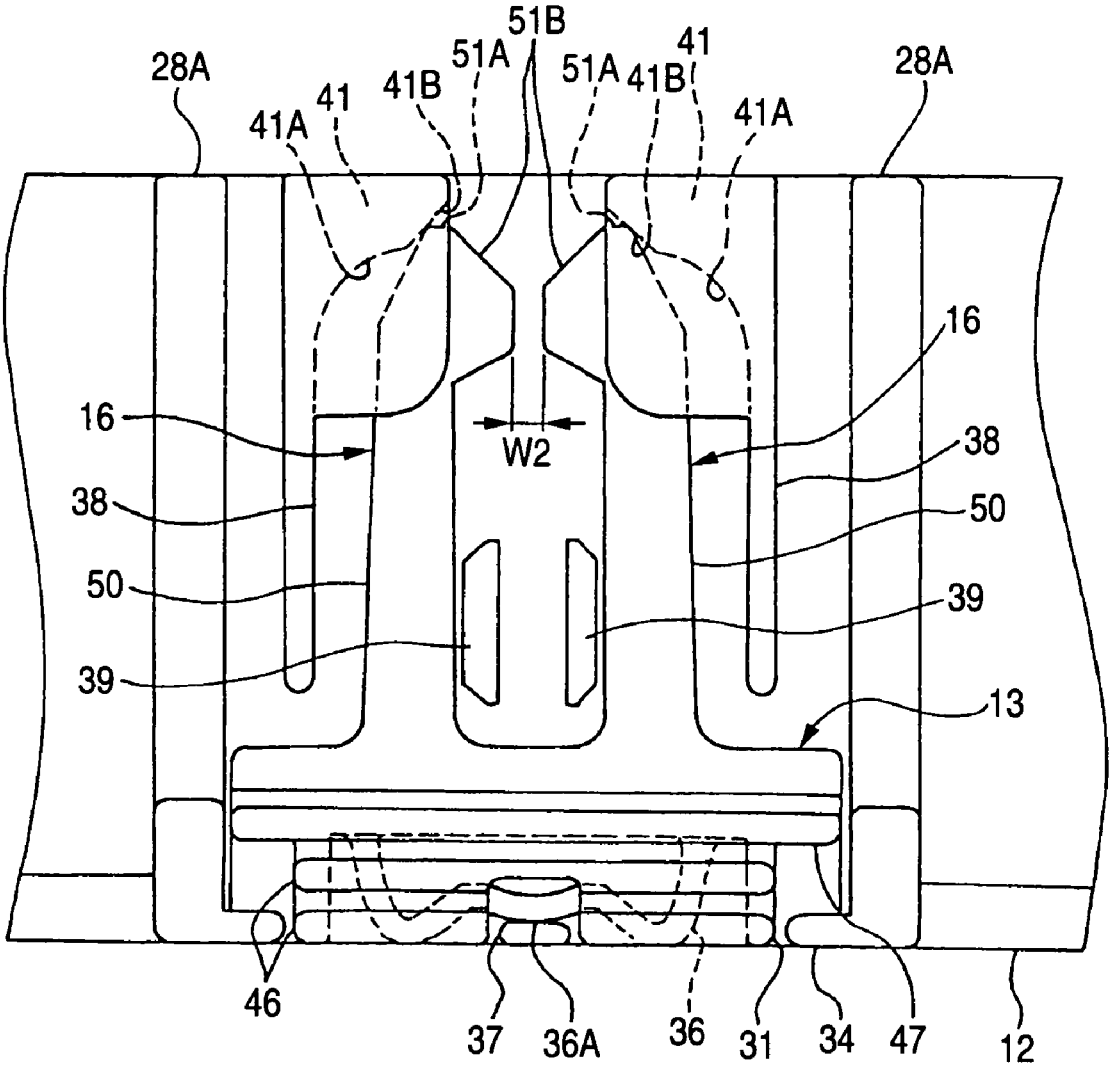
FIG. 8 is a plan view showing a condition in which the slide lock member is mounted on the male connector housing of FIG. 1.

Preferred embodiments of the present invention will now be described in detail with reference to the drawings.

First Embodiment

As shown in FIGS. 1 to 8, when the male connector 3, including the male connector housing 12 receiving a plurality of first terminals (not shown) of one of a male terminal type and a female terminal type, is fitted in the female connector 2 including the female connector housing 11 receiving a plurality of second terminals (not shown) of the other terminal type (for electrical connection to the first terminals), the first embodiment of the connector lock structure 1 of the invention locks the female and male connectors to each other by engaging a retaining portion 16 of the slide lock member 13 (mounted on the male connector housing 12) with an engagement projection (engagement portion) 14 formed on the female connector housing 11.

The female connector housing 11 includes a hood portion 11B surrounding the second terminals, and the male connector housing 12 can be inserted into and withdrawn from this hood portion 11B. A receiving portion 22 for receiving the slide lock member 13 (described later), as well as the engagement projection 14, is formed on an inner surface of the hood portion 11B, and the engagement projection 14 projects into the receiving portion 22. The slide lock member 13, having the retaining portion 16 for engagement with the engagement projection 14 of the female connector housing 11, is mounted on an outer surface of the male connector housing 12. This slide lock member 13 is supported on the male connector housing 12 in such a manner that the slide lock member 13 is movable relative to the male connector housing in a connector inserting direction and a connector withdrawing direction (that is, a connector inserting/withdrawing direction).

The female connector housing has a generally rectangular parallelepiped shape, and includes a base portion 11A which supports the second terminals in such a manner that distal end portions of the second terminals project perpendicularly from one end surface thereof and that the second terminals are arranged in a row in a longitudinal direction of the end surface. The hood portion 11B of the female connector housing 11 extends from an outer peripheral portion of the end surface of the base portion 11A in the same direction as the direction of projecting of the second terminals, and this hood portion 11B is formed into a generally rectangular tubular shape. The connector inserting/withdrawing direction is the direction of the axis of the hood portion 11B (In other words, the direction of projecting from the end surface of the base portion 11A). The female connector housing 11 is fixed to a board (not shown), and the proximal end portions of the second terminals are electrically connected to printed wiring formed on this board.

A pair of ribs 21A and 21A, forming the receiving portion 22 for receiving the slide lock member 13, are formed on and project from a lengthwise-central portion of the upper inner surface of the hood portion 11B, and extend in the connector inserting/withdrawing direction. A plurality of ribs 21*b* are formed on and project from the inner surface of the hood portion 11B except the receiving portion 22, and extend in the connector inserting/withdrawing direction.

The engagement projection 14 for engagement with the retaining portion 16 of the slide lock member 13 is formed at a central portion of the receiving portion 22 of the hood portion 11B, and projects from the upper inner surface thereof, and extends in the connector inserting/withdrawing direction. A pair of front inclining surfaces 14A and 14A which are tapering toward an open end of the hood portion 11B are formed at that end portion (hereinafter referred to as "front end portion") of the engagement projection 14 disposed close to the open end of the hood portion 11B. A pair of rear inclining surfaces 14B and 14B which are tapering toward the base portion 11A are formed at a rear end portion of the engagement projection 14. A guide plate 24 in the form of a thin plate having a thickness W1 is formed at the front end portion of the engagement projection 14, and extends forwardly, while a projecting piece-like partition wall 25 in the form of a thin plate having a thickness W1 is formed at the rear end portion of the engagement projection 14, and extends rearwardly.

A window 26 of a generally rectangular shape is formed through the wall of the base portion 11A, and is aligned with the engagement projection 14 in the connector inserting/withdrawing direction.

The male connector housing 12 is formed into a generally rectangular parallelepiped shape corresponding to the shape of the inner surface of the hood portion 11B of the female connector housing 11. A length of the male connector housing 12 in the connector inserting direction is so determined that when the female and male connectors are fitted together, that end portion of the male connector housing 12, disposed at the rear side in the direction of fitting thereof into the hood portion 11B (that is, in the connector inserting direction), can be exposed from the hood portion 11B. An opening is formed in an end surface of the end portion of the male connector housing 12 disposed at the rear side in the connector inserting direction, and a receiving space of a generally rectangular parallelepiped shape for receiving the plurality of first terminals is formed within the male connector housing 12. The plurality of first terminals are supported by a holding member (not shown), and are arranged in a row in the longitudinal direction. This holding member is so formed as to fit in the above receiving space in the male connector housing 12. Lead portions (not shown), provided at a wire harness (not shown), are electrically connected respectively to proximal end portions of the plurality of first terminals. A plurality of through holes (not shown) are formed through that end wall of the male connector housing 12, disposed at the front side in the connector inserting direction, so that when the female and male connectors are fitted together, the plurality of second terminals, received in the female connector housing 11, can reach the plurality of first terminals, respectively.

A pair of guide rails 28A and 28A, forming a mounting portion for the slide lock member 13, are formed on and project from a lengthwise-central portion of the upper surface of the male connector housing 12, and extend in the connector inserting/withdrawing direction. Each guide rail 28A extends from the front end of the male connector housing 12 to the rear end thereof.

A plurality of guide rails 28B are formed on and project from the outer surface of the male connector housing 12 except the mounting portion for the slide lock member 13, and extend in the connector inserting/withdrawing direction. When the female and male connectors are fitted together, each of the guide rails 28B is inserted into a guide groove formed between the corresponding pair of adjacent ribs 21B and 21B formed on the hood portion 11B of the female connector housing 11. Therefore, when fitting the female and male connectors together, the male connector housing 12 can be accurately positioned relative to the female connector housing 11, and the male connector housing 12 can be smoothly inserted into the hood portion 11B of the female connector housing 11.

An abutment projection 29 in the form of a pillar of a rectangular cross-section is formed at that end portion of each of the pair of guide rails 28A and 28A (which is disposed at the rear side in the connector inserting direction) which is exposed from the hood portion 11B when the female and male connectors are fitted together. These abutment projections 29 abut against the end surface of the hood portion 11B of the female connector housing 11 to thereby prevent the male housing 12 from being excessively inserted into the hood portion 11B. Each abutment projection 29 projects from an upper surface of the corresponding guide rail 28A, and extends along the guide rail 28A.

Tip-like withdrawal prevention portions 34 for preventing the disengagement of the slide lock member 13 are formed respectively at those ends of the abutment projections 29 disposed at the rear side in the connector inserting direction, and the pair of withdrawal prevention portions 34 are formed respectively on opposed side surfaces of the pair of abutment projections 29 and 29, and project toward each other. An opening portion 31 for enabling the slide lock member 13 to be inserted into the mounting portion is formed between the pair of withdrawal prevention portions 34 and 34, and a support projection 37 for abutting against urging member (described later) of the slide lock member 13 is provided at a central portion of the opening portion 31, and projects from the upper surface of the connector housing 12.

A pair of partition walls 38 and 38 are formed in an upstanding manner between the pair of guide rails 28A and 28A, and are spaced a predetermined distance from the guide rails 28A, respectively. Each partition wall 38 extends from the front end of the male connector housing 12 to a generally central portion thereof in the connector inserting/withdrawing direction. Guide portions 41 are formed respectively at ends (disposed at the front side in the connector inserting direction) of the pair of partition walls 38 and 38, and the distance between opposed side surfaces of the pair of guide portions 41 and 41 is decreasing gradually in the connector inserting direction, and each of these side surfaces is formed by a curved surface 41A and an inclining surface 41B. The pair guide portions 41 and 41 extend inwardly toward the mounting portion for the slide lock member 13. Each guide portion 41 (the curved surface 41A and the inclining surface 41B) is covered at its upper side with a cover 42 of a generally rectangular shape. A passage groove 15 for the passage of the engagement projection 14 of the female connector housing 11 therethrough is formed between the projected ends of the pair of guide portions 41 and 41.

A pair of reinforcing plates 39 and 39 are provided rearwardly of the passage groove 15 in the connector inserting direction, and are spaced a predetermined distance from each other in the longitudinal direction of the male connector housing. Each reinforcing plate 39 is formed on and projects from the upper surface of the male connector housing 12, and extends in the connector inserting/withdrawing direction. When the female and male connectors are fitted together, the guide plate 24 of the engagement projection 14 of the female connector housing 11 is received in the space between the pair of reinforcing plates 39 and 39.

The slide lock member 13 of an integral construction includes a generally rectangular plate-like body 45, the retaining portion 16 for engagement with the engagement projection 14 of the female connector housing 11, and an elastic member 36 (serving as the urging member) for urging the slide lock member 13, and these portions are formed integrally with one another.

The retaining portion 16 includes a pair of retaining piece portions 50 and 50 (which jointly assume a generally tuning fork-shape) extending from that surface thereof which is disposed at the front side in the connector inserting direction when the slide lock member is mounted on the male connector housing 12. A retaining claw 51 is formed at a distal end of each of the two retaining piece portions 50 and 50. The pair of retaining piece portions 50 and 50 can be elastically deformed so that the retaining claws 51 and 51, formed respectively at the distal ends thereof, can be moved toward and away from each other in the longitudinal direction of the male connector housing. The pair of retaining claws 51 and 51 are formed on and project respectively from opposed side surfaces of the retaining piece portions 50 and 50 such that each retaining claw 51 bulges into a generally trapezoidal shape. Each retaining claw 51 includes a distal abutment surface 51A directed forwardly in the connector inserting direction, a front inclining surface 51B extending continuously from the distal abutment surface 51A, a gripping surface 51C extending continuously from the front inclining surface 51B, and a rear inclining surface 51D extending continuously from the gripping surface 51C. The front inclining surfaces 51B of the two retaining claws 51 and 51 are so inclined that the distance between the two is decreasing gradually in the direction opposite to the connector inserting direction. The two gripping surfaces 51C are opposed to each other. The two rear inclining surfaces 51D are so inclined that the distance between the two is increasing gradually in the direction opposite to the connector inserting direction.

A notch of a generally rectangular shape is formed in an end portion (disposed at the rear side in the connector inserting direction) of the body 45 to provide a receiving portion 48, and the elastic member 36 is received within this receiving portion 48. The elastic member is formed into a generally M-shape, and two leg portions thereof are integrally connected to an inner surface of the receiving portion 48.

The upper side of the receiving portion 48 is covered by a generally-rectangular plate-like operating portion 46. When the female and male connectors are fitted together, the operating portion 46 is exposed from the hood portion 11B of the female connector housing 11, and also a front surface (disposed at the front side in the connector inserting direction) thereof abuts against the end surface of the hood portion 11B. An upper surface of the operating portion 46 is formed into a generally corrugated shape by three ribs 46A which are formed on and project from this upper surface, the ribs 46A extending in the longitudinal direction of the male connector housing in parallel relation to one another. Rear corner portions (disposed at the rear side in the connector inserting direction) of the operating portion 46 are notched, and stoppers 47 for abutting respectively against the withdrawal prevention portions 34 of the male connector housing 12 are formed at these rear corner portions, respectively.

Three slide projections 52 are formed on and slightly project from the lower surface of the body 45, and extend in the direction of movement of the slide lock member 13 (that is, in the connector inserting/withdrawing direction). The slide projections 52 serve to reduce an area of sliding contact between the slide lock member 13 and the male connector housing 12 so as to achieve a smooth movement of the slide lock member 13.

When the slide lock member 13 is mounted on the male connector housing 12, the slide lock member 13 is disposed between the pair of guide rails 28A and 28A formed on the male connector housing 12. The pair of guide rails 28A and 28A extend in the connector inserting direction, and the slide lock member 13 is supported by the guide rails 28A so as to move therealong in the connector inserting/withdrawing direction, with the opposite side surfaces thereof disposed in sliding contact respectively with the opposed side surfaces of the two guide rails 28A.

Each retaining piece portion 50 of the retaining portion 16 of the slide lock member 13 is disposed between the corresponding partition wall 38 and reinforcing plate 39, and the retaining claws 51 are disposed respectively beneath the covers 42 covering the respective support portions (guide portions) 41 (that is, the retaining claws 51 are covered with the covers 42, respectively) The distal abutment surfaces 51A of the retaining claws 51 are held respectively against the inclining surfaces 41B of the guide portions 41 of the partition walls 38, and therefore are located in predetermined positions, respectively. In this condition, the distance between the gripping surfaces 51C and 51C of the pair of retaining claws 51 and 51 is W2. The pair of reinforcing plates 39 and 39 are disposed between the pair of retaining piece portions 50 and 50, and hold the inner side surfaces of the retaining piece portions 50 and 50, respectively, thereby preventing the shaking of the retaining piece portions 50 and also preventing the retaining piece portions 50 from being excessively elastically deformed inwardly.

An abutment portion 36A, formed at a central portion of the elastic member 36, is held in contact with the support projection 37. When the slide lock member 13 is moved relative to the male connector housing 12 in the connector withdrawing direction, the abutment portion 36A is pressed against the support projection 37, and is held in a fixed position, so that the abutment portion 36A moves inwardly relative to the receiving portion 48. As a result, the elastic member 36 is elastically deformed to urge the slide lock member 13 in the connector inserting direction.

Next, the locking operation of the female and male connectors 2 and 3 will be described with reference to FIGS. 9(A) to 9(D).

Figure 9:
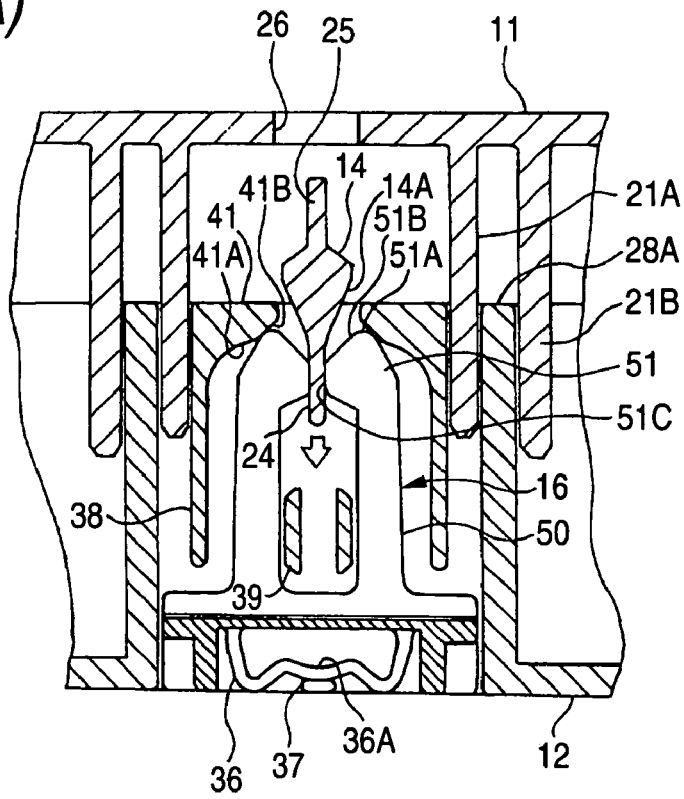
FIGS. 9A to 9D are horizontal cross-sectional views showing a locking operation for female and male connectors of FIG. 1.
Figure 9:
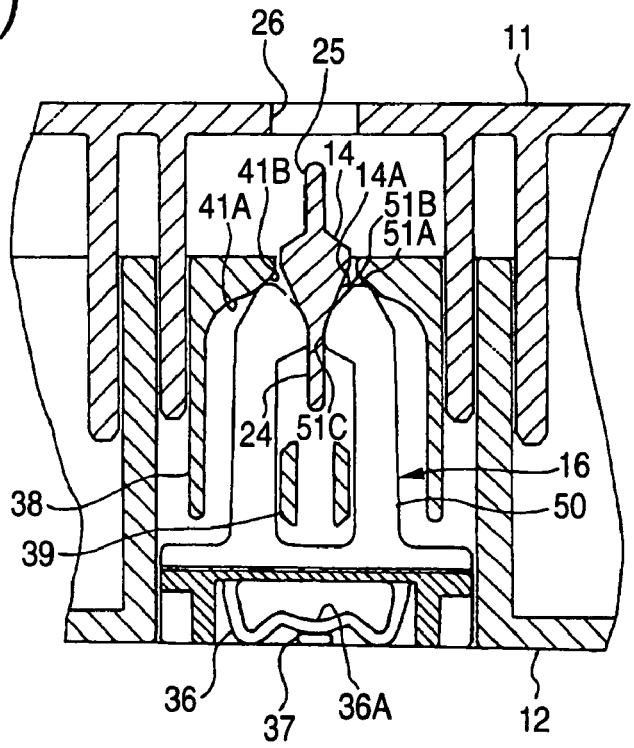
Figure 9:
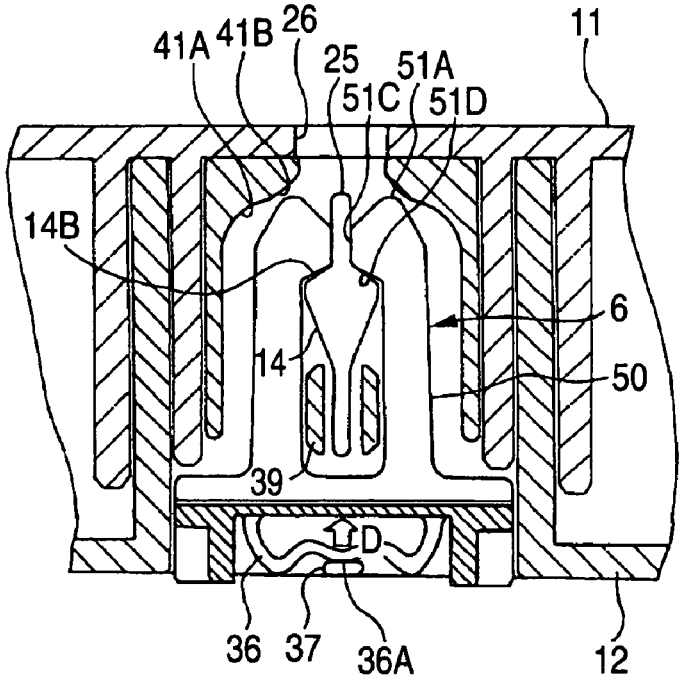
Figure 9:
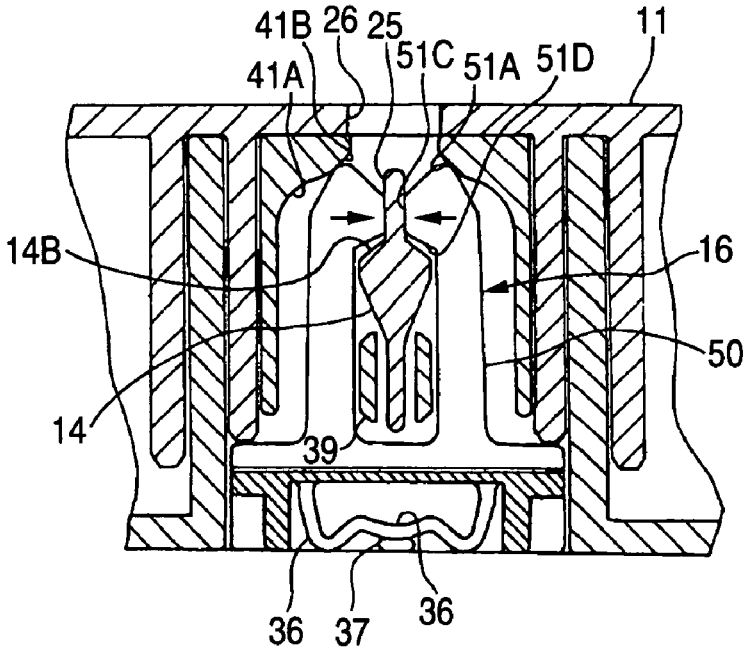

The slide lock member 13 is mounted on the male connector housing 12, and in this condition the male connector housing 12 is inserted into the hood portion 11B of the female connector housing 12 as shown in FIG. 9(A). At this time, the pair of partition walls 38 and 38, as well as the retaining portion 16 of the slide lock member 13 disposed therebetween, enters the receiving portion 22 of the hood portion 11B. The engagement projection 14 passes through the passage groove 15, and the guide plate 24 of the engagement projection 14 is inserted between the pair of retaining claws 51 and 51. Here, the distance W2 between the gripping surfaces 51C and 51C of the pair of retaining claws 51 and 51 and the width (thickness) W1 of the guide plate 24 are so determined that the relation (W2≦W1) is established. The guide plate 24 of the engagement projection 14 moves along the pair of front inclining surfaces 51B and 51B, and is positively guided into a position disposed centrally between the pair of retaining claws 51 and 51 while elastically deforming the pair of retaining piece portions 50 in such a manner as to move the gripping surfaces 51*c* and 51C away from each other (that is, in directions of arrow B in the drawings) to thereby slightly increase the distance W2 between these gripping surfaces 51C and 51C.

When the male connector housing 12 is inserted into the female connector housing 11 as shown in FIG. 9B, the front inclining surfaces 14A of the engagement projection 14 abut respectively against the front inclining surfaces 51B of the retaining claws 51, thereby elastically deforming the retaining piece portions 50 so as to further increase the distance between the gripping surfaces 51C and 51C of the pair of retaining claws 51 and 51. At the same time, the front inclining surfaces 14A press the respective retaining claws 51, and move the slide lock member 13 relative to the male connector housing 12 in the connector withdrawing direction.

At this time, the abutment portion 36A of the elastic member 36 abuts against the support projection 37, and is held in the fixed position, so that the abutment portion 36A moves inwardly relative to the receiving portion 48. As a result, the elastic member 36 is elastically deformed, and because of its restoring action, the elastic member 36 produces an urging force for urging the slide lock member 13 to move in the connector inserting direction. When the slide lock member 13 is moved a predetermined distance in the connector withdrawing direction, the operating portion 46 of the slide lock member 13 projects from the opening portion 31, and also the stoppers 47 and 47 (formed respectively at the opposite side portions of the operating portion 46) abut respectively against the pair of withdrawal prevention portions 34 provided at the opening portion 31, thereby preventing the slide lock member 13 from being further moved in the connector withdrawing direction.

When the male connector housing 12 is completely inserted into the hood portion 11B of the female connector housing 11 as shown in FIG. 9(C), the engagement projection 14 reaches an engagement position where it is engaged with the retaining portion 16. At this time, the engagement of the front inclining surface 51B of each retaining claw 51 with the corresponding front inclining surface 14A of the engagement projection 14 is canceled, and as a result the slide lock member 13 is moved in the connector inserting direction by the urging force of the elastic member 36. The guide plate 24 is received between the pair of reinforcing plates 39 and 39, and the engagement projection 14 is received between the pair of retaining piece portions 50 and 50. Therefore, the rear inclining surfaces 51D of the retaining claws 51 are engaged with the rear side of the engagement projection 14. In FIG. 9C, the operating portion 46 of the slide lock member 13 slightly projects from the opening portion 31, and therefore the elastic member 36 is not yet completely restored from the elastically-deformed condition, and therefore still produces the urging force urging the slide lock member 13 in the connector inserting direction.

The slide lock member 13 is automatically moved from the condition of FIG. 9C in the connector inserting direction by the urging force of the elastic member 36 as shown in FIG. 9D, so that the distal abutment surfaces 51A of the retaining claws 51 abut respectively against the inclining surfaces 41B of the guide portions 41. At this time, the retaining claws 51 and 51 move along the respective inclining surfaces 41B while elastically deforming the retaining piece portions 50, so that the distance between the gripping surfaces 51C and 51C of the pair of retaining claws 51 and 51 is reduced. As a result, the partition wall 25, having the thickness W1, is held between the pair of retaining claws 51 and 51 (In other words, the pair of retaining claws 51 and 51 are pressed toward each other through the partition wall 25). By the above operation, the engagement projection 14 is positively retained by the retaining portion 16, thus completing the locking operation of the female and male connectors.

When the locking operation is completed, the operating portion 46 of the slide lock member 13 does not project from the opening portion 31, and is disposed flush with the rear end surface of the male connector housing 12. On the other hand, during the locking operation (for example, see FIG. 9C), the operating portion 46 projects from the opening portion 31 in the direction opposite to the connector inserting direction. Thus, the completion of the locking operation can be confirmed with the eyes. Also, the engaged condition of the engagement projection 14 and retaining portion 16 can be confirmed with the eyes through the window 26 formed in the base portion 11A of the female connector housing 11.

Figure 10:
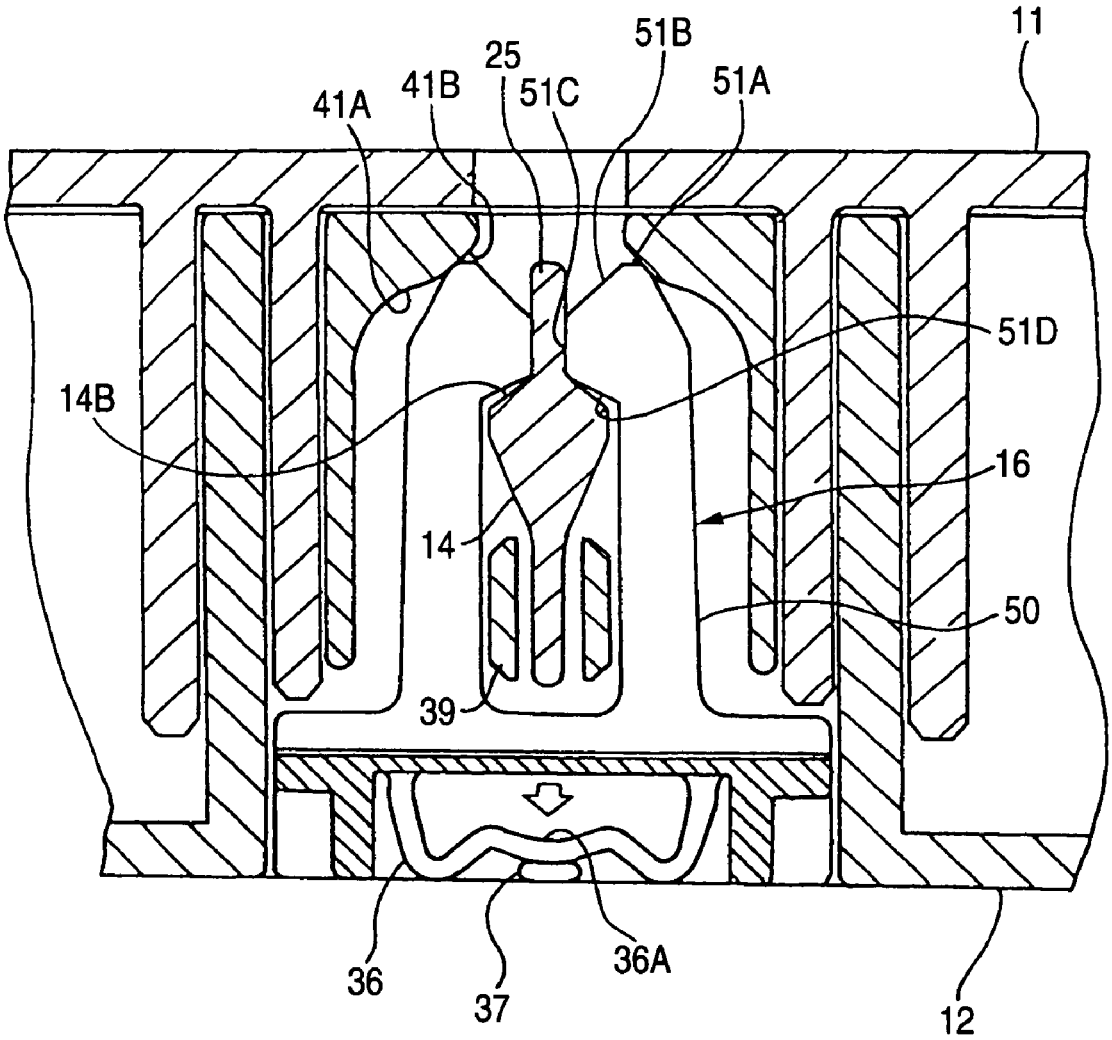
FIG. 10 is a horizontal cross-sectional view showing an unlocking operation for the female and male connectors of FIG. 1.
Figure 11:
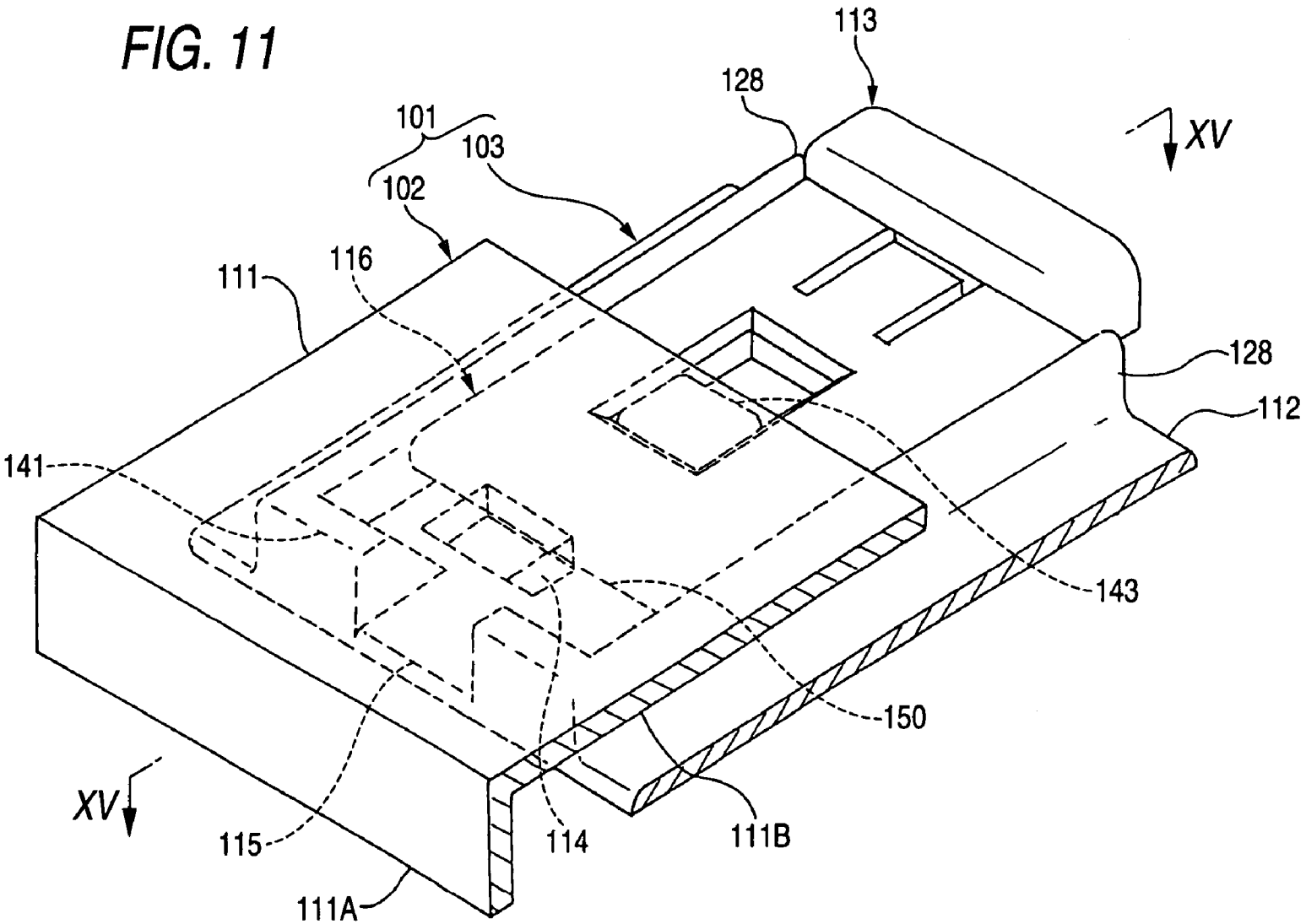
FIG. 11 is a perspective view showing an important portion of a second embodiment of a connector lock structure of the invention.
Figure 12:
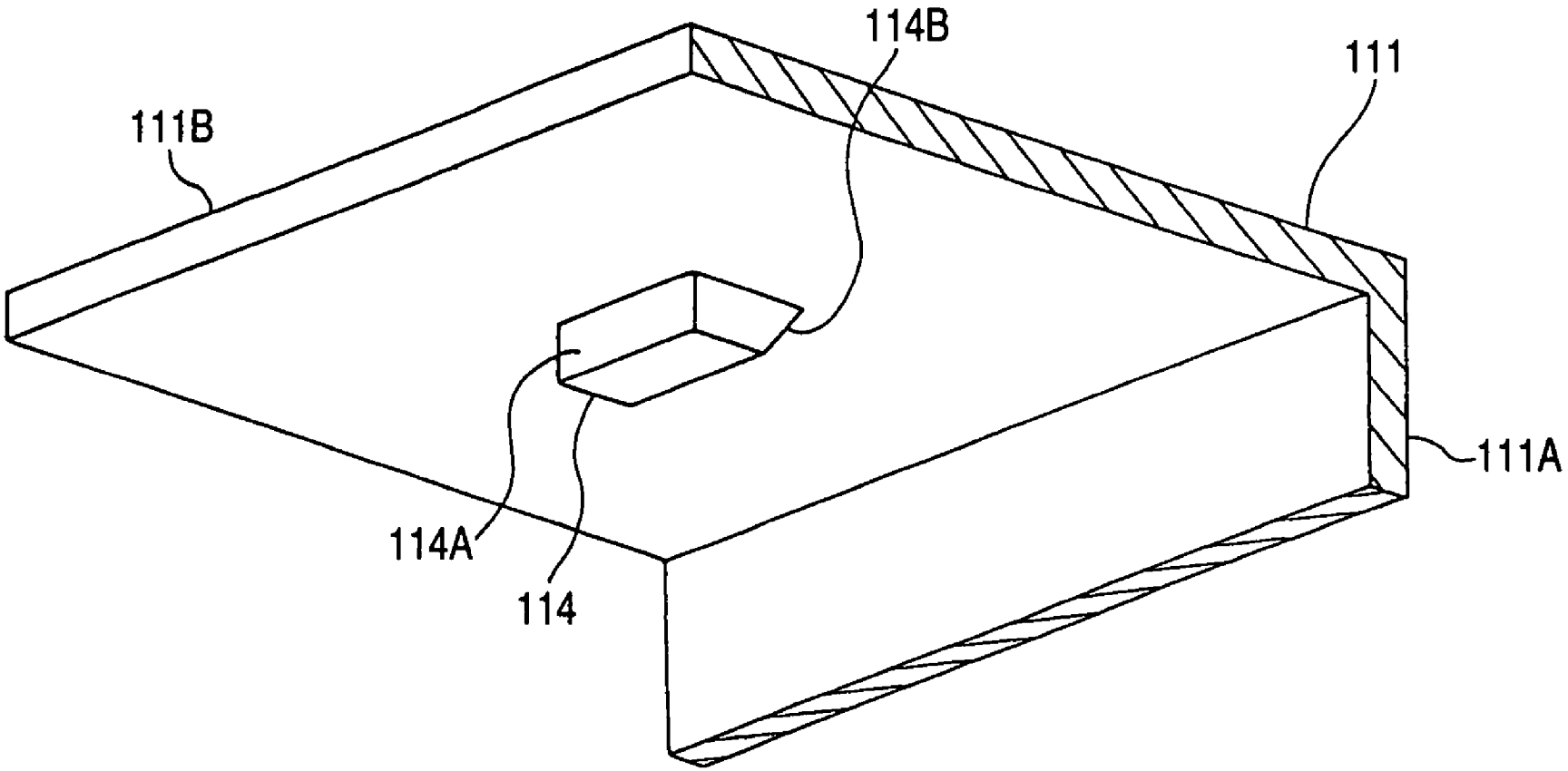
FIG. 12 is a perspective view showing a female connector housing of FIG. 11 alone.
Figure 13:
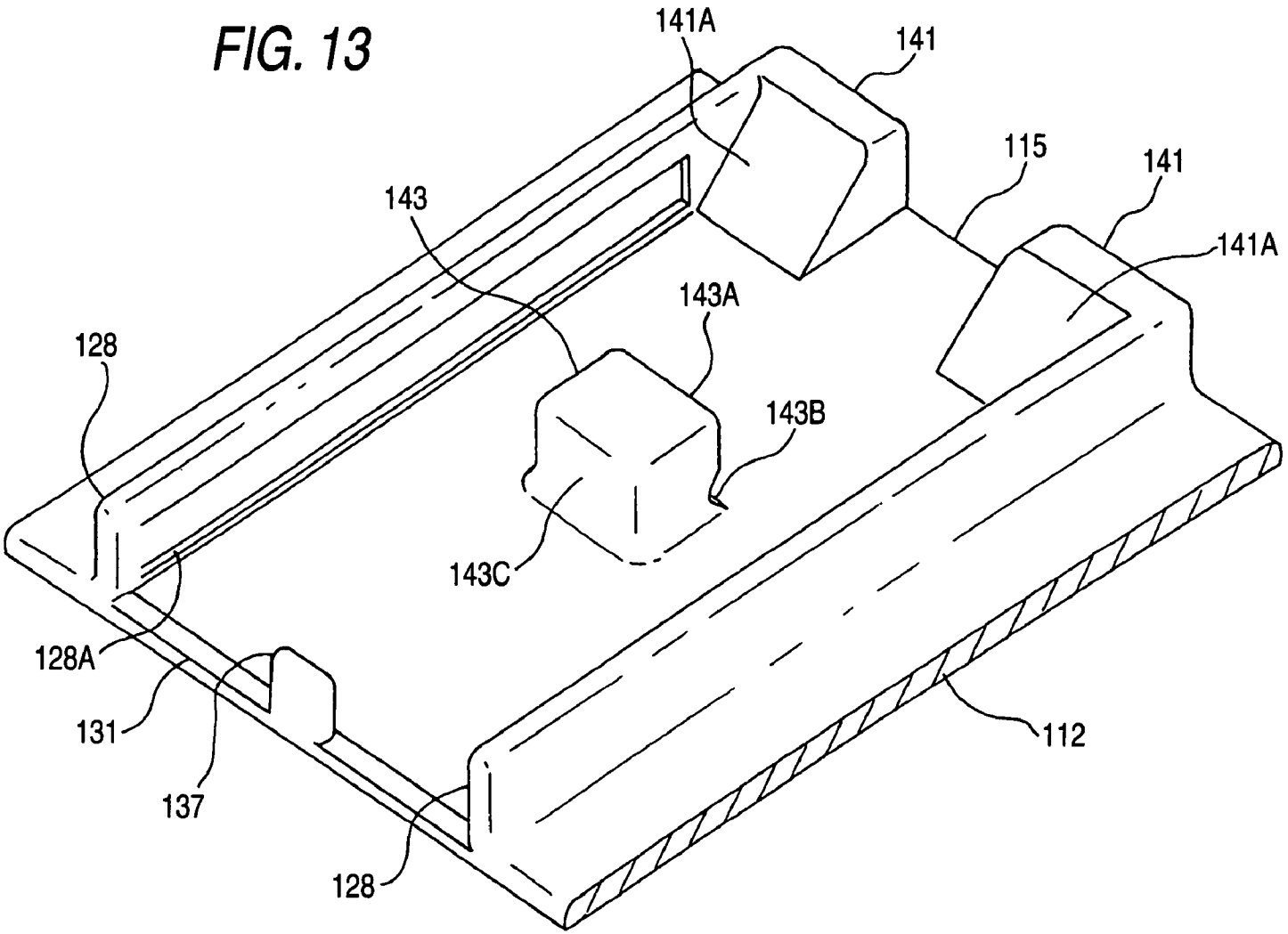
FIG. 13 is a perspective view showing a male connector housing of FIG. 11 alone.
Figure 14:
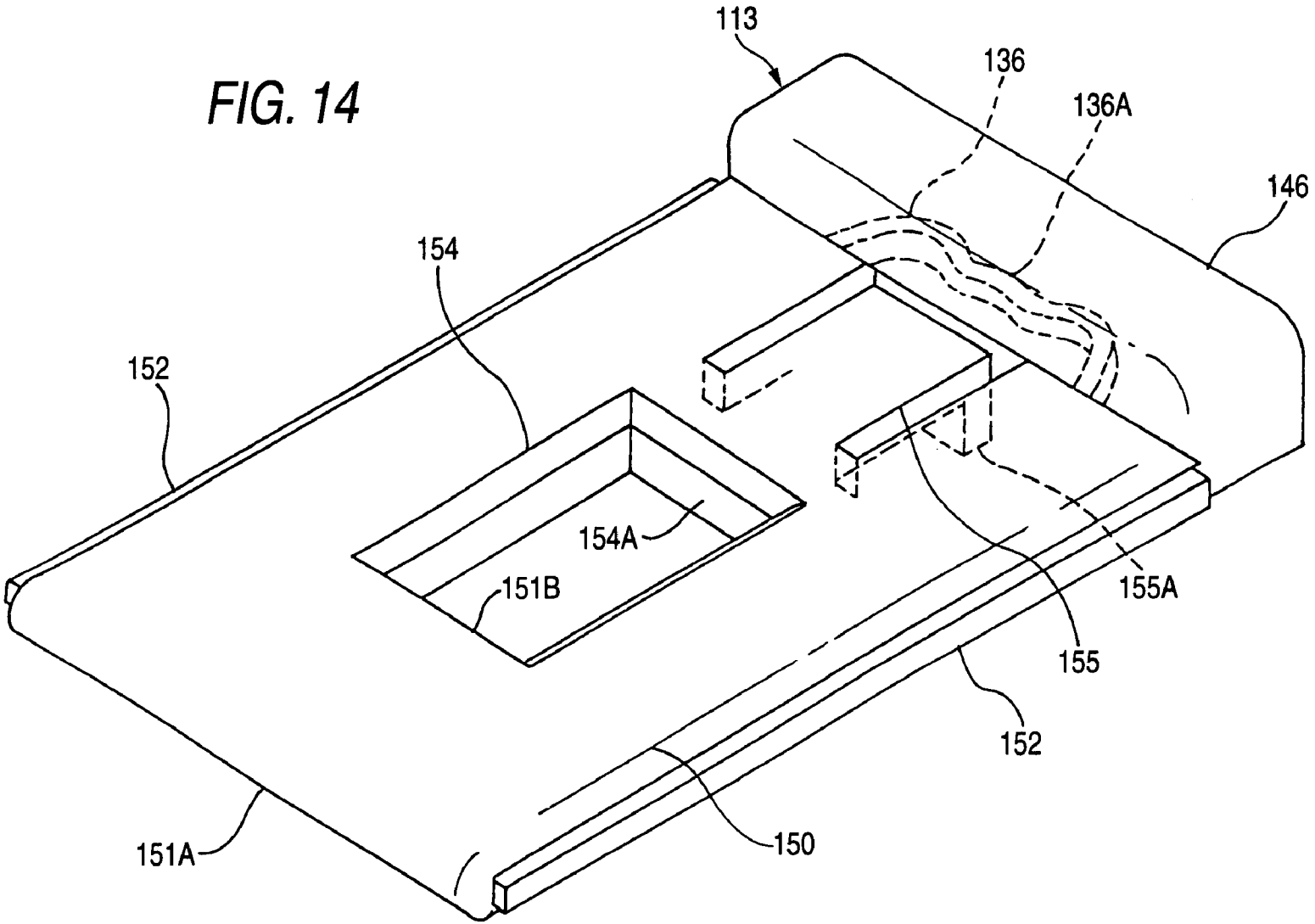
FIG. 14 is a perspective view showing a slide lock member of FIG. 11 alone.
Figure 15:
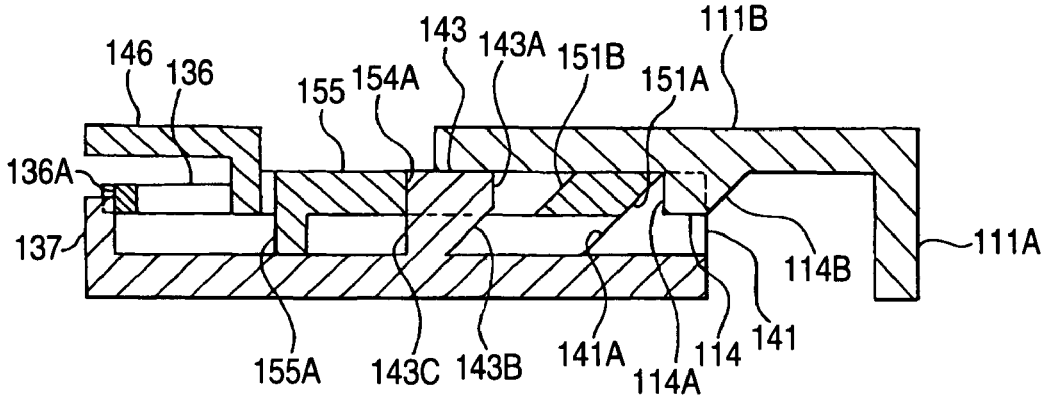
FIGS. 15A to 15E are vertical cross-sectional views showing a locking operation for female and male connectors of FIG. 11.
Figure 15:
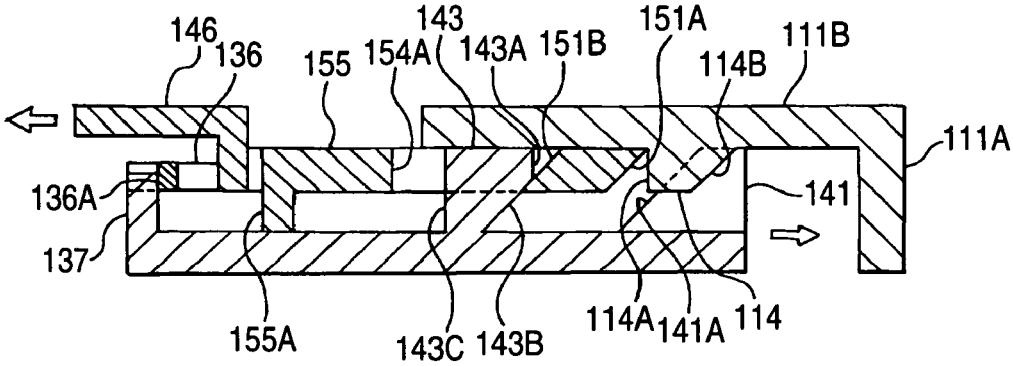
Figure 15:
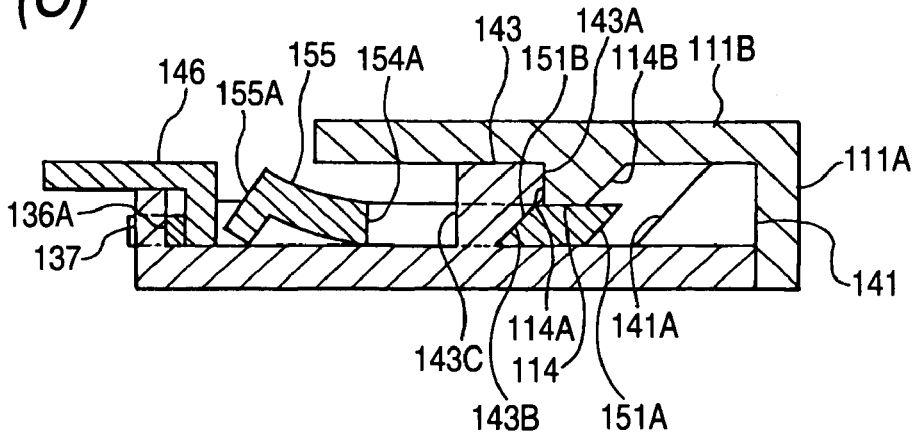
Figure 15:
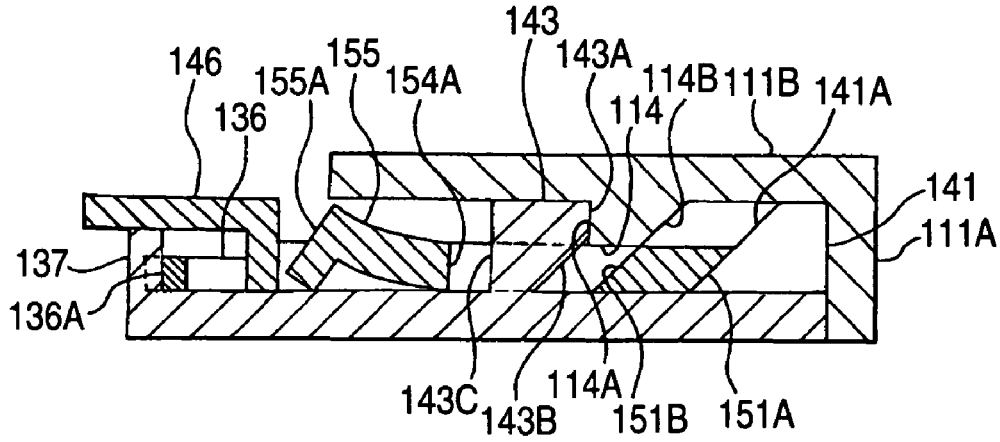
Figure 15:
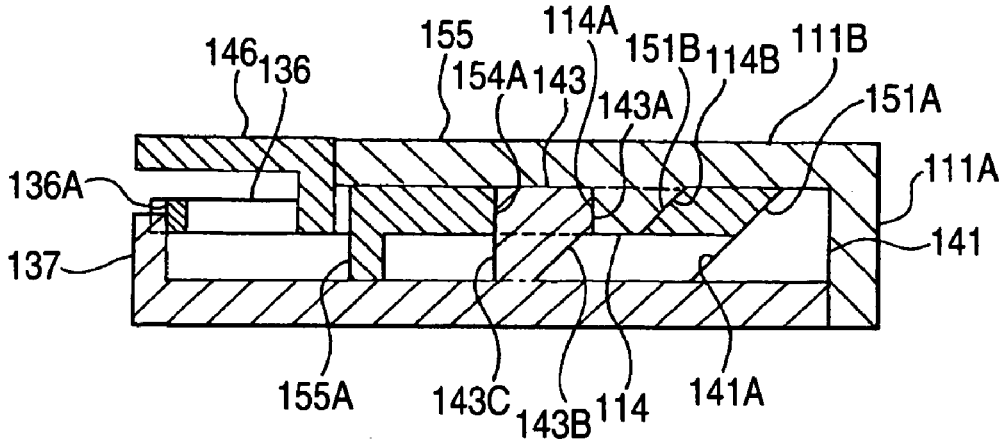

For canceling the locked condition of the female connector 2 and male connector 3, the operating portion 46 of the slide lock member 13 is operated to move the slide lock member 13 in the connector withdrawing direction (see FIG. 10). At this time, the rear inclining surfaces 51D of the retaining claws 51 abut respectively against the rear inclination surfaces 14B of the engagement projection 14, and the retaining claws 51 move respectively along the rear inclination surfaces 14B while elastically deforming the retaining piece portions 50 in such a manner as to increase the distance between the pair of gripping surfaces 51C and 51C. Then, when the retaining claws 51 slide past the engagement projection 14, the locked condition of the female and male connectors is canceled. In this condition, when the slide lock member 13 is further moved in the connector withdrawing direction, the stoppers 47 of the slide lock member 13 abut against the withdrawal prevention portions 34 of the male connector housing 12, and thereafter the male connector housing 12 is also moved together with the slide lock member 13 in the connector withdrawing direction, and is easily withdrawn from the female connector housing 11.

Incidentally, when the male connector housing 12 is operated, the rear inclining surfaces 51D of the retaining claws 51 abut respectively against the rear inclination surfaces 14B of the engagement projection 14, and serve to increase the distance between the pair of gripping surfaces 51C and 51C. However, the inclining surfaces 41B of the guide portions 41 abut respectively against the distal abutment surfaces 51A of the retaining claws 51, and serve to decrease the distance between the pair of gripping surfaces 51C and 51C. Therefore, the retaining claws 51 can not slide past the engagement projection 14, and the locked condition of the female and male connectors can not be canceled.

Incidentally, the pair of retaining piece portions 50 and 50 are disposed symmetrically with respect to an imaginary centerline of the engagement projection 14 parallel to the connector inserting/withdrawing direction, and with this arrangement the pair of retaining piece portions 50 and 50 can be elastically deformed equally and symmetrically with respect to the imaginary centerline, and force components of the restoring forces of the retaining piece portions 50 which intersect the connector inserting/withdrawing direction cancel each other. Therefore, only force components parallel to the connector inserting/withdrawing direction (that is, the direction of movement) act on the slide lock member 13, so that the slide lock member 13 is prevented from being inclined while it is moved, and therefore the slide lock member 13 can be moved without shaking, and the operability of the slide member can be enhanced.

Second Embodiment

Next, a second embodiment of a connector lock structure 101 of the invention will be described in detail with reference to FIGS. 11 to 15. Members and others which are similar in construction and operation to those of the first embodiment will be designated respectively by identical or corresponding reference numerals in the drawings, and explanation thereof will be simplified or omitted.

As shown in FIGS. 11 to 14, when the male connector 103, including the male connector housing 112 receiving a plurality of first terminals (not shown) of one of a male terminal type and a female terminal type, is fitted in the female connector 102 including the female connector housing 111 receiving a plurality of second terminals (not shown) of the other terminal type (for electrical connection to the first terminals), the second embodiment of the connector lock structure 101 of the invention locks the female and male connectors to each other by engaging a retaining portion 116 of the slide lock member 113 (mounted on the male connector housing 112) with an engagement projection (engagement portion) 114 formed on the female connector housing 111. The female connector housing 111 is different only in the engagement portion from the female connector housing 11 of the first embodiment, and the other construction is similar to that of the female connector housing 11 of the first embodiment. The male connector housing 112 is different from the male connector housing 12 of the first embodiment only in that a mounting portion for the slide lock member has a different construction, and the other construction is similar to that of the male connector housing 12 of the first embodiment.

A receiving portion for receiving the slide lock member 113 (described later) is formed at a central portion of an upper inner surface of a hood portion 111B of the female connector housing 111. The engagement projection 114 in the form of a pillar of a generally rectangular cross-section is formed in a projecting manner at this receiving portion. A front surface 114A of the engagement projection 114, directed toward an open end of the hood portion 111B, is disposed perpendicular to the upper inner surface, and a rear surface 114B thereof, directed toward a base portion 11A, is slanting relative to the upper inner surface.

A pair of ribs 128 and 128 for forming the mounting portion for the slide lock member 113 are formed on an upper surface of the male connector housing 112. The two ribs 128 are spaced a predetermined distance from each other, and extend in a connector inserting/withdrawing direction. Guide grooves 128A for engagement respectively with guide rails 152 of the slide lock member 113 (described later) are formed respectively in those side surfaces of the two ribs 128 and 128 opposed to each other, and extend in the connector inserting/withdrawing direction. The guide grooves 128A support the slide lock member 113 in such a manner that the slide lock member 113 can be moved in the connector inserting/withdrawing direction and also in an upward-downward direction.

First guide portions 141 for guiding the upward movement of the slide lock member 113 are formed respectively at ends (disposed at the front side in the connector inserting direction) of the pair of ribs 128 and 128. The first guide portions 141 are formed on and project respectively from opposed side surfaces of the two ribs 128 toward the inside of the mounting portion for the slide lock member 113. An end surface (disposed at the rear side in the connector inserting direction) of each first guide portion 141 is defined by a slanting surface 141A slanting upwardly in the connector inserting direction. A passage groove 115 for the passage of the engagement projection 114 of the female connector housing 111 therethrough is formed between the pair of first guide portions 141 and 141.

A second guide portion 143 of a generally square pillar-shape for guiding the upward movement of the slide lock member 113 is provided rearwardly of the passage groove 115 in the connector inserting direction. That side of a proximal end portion of the second guide portion 143, disposed at the front side in the connector inserting direction, is notched in an undercut manner to provide a slanting surface 143B slanting downwardly in the connector withdrawing direction. The second guide portion 143 has a front abutment surface 143A extending continuously from the slanting surface 143B, and is disposed perpendicular to the upper surface of the male connector housing 12.

An opening portion 131 is formed at an edge portion (disposed at the rear side in the connector inserting direction) of the male connector housing 112 by the pair of ribs 128 and 128 forming the mounting portion for the slide lock member 113, and a support projection 137 for abutting against an elastic member 136 of the slide lock member (described later) is formed in a projecting manner at this opening portion 131.

The slide lock member 113 is molded into a generally-rectangular thin plate-shape, using a synthetic resin. The guide rails 152 and 152 for engagement respectively in the guide grooves 128A and 128A (formed respectively in the pair of ribs 128 and 128 of the male connector housing 112) are formed at opposite side portions of the slide lock member 113, respectively.

A notch of a generally rectangular shape is formed in an end portion (disposed at the rear side in the connector inserting direction when the slide lock member is mounted on the male connector housing 112) of the slide lock member to provide a recess-like receiving portion similar to the receiving portion 48 of the first embodiment. The elastic member 136, serving as urging member for urging the slide lock member 113 in the connector inserting direction, is received within this receiving portion.

The elastic member 136 is formed into a generally M-shape as described above for the elastic member 36 of the first embodiment, and two leg portions thereof are integrally connected to an inner surface of the receiving portion. The elastic member 136 is elastically deformed, with its central abutment portion 136A abutting against the support projection 137 of the male connector housing 112, and its restoring action produces an urging force for urging the slide lock member 113 in the connector inserting direction. The upper side of the elastic member 136 (and hence the upper side of the receiving portion) is covered with an operating portion 146, and therefore the operating portion 146 is provided in a projecting manner.

The retaining portion 116 is formed by a retaining frame 150 forming a through hole 154 formed through a generally-central portion of the slide lock member 113. When the slide lock member 113 is mounted on the male connector housing 112, the second guide portion 143 of the male connector housing 112 is received in the through hole 154. An end surface (disposed at the front side in the connector inserting direction) of the retaining frame 150 is defined by a front slanting surface 151A generally parallel to the slanting surfaces 141A of the first guide portions 141. An end surface of the retaining frame 150, opposed to the front abutment surface 143A of the second guide portion 143, is defined by a rear slanting surface 151B slanting in generally parallel relation to the slanting surface 143B of the second guide portion 143.

The slide lock member 113 has a tongue-like support piece portion 155 formed as a result of forming a generally U-shaped slit therethrough. The support piece portion 155 is elastically deformable, and an abutment portion 155A is formed at a distal end of the support piece portion 155, and projects downwardly from a body 145. The abutment portion 155A abuts against the upper surface of the male connector housing 112 to urge the body 145 upwardly.

Next, the operation for locking the female and male connector housings 111 and 112 to each other by the slide lock member 113 will be described with reference to FIGS. 15A to 15E.

The slide lock member 113 is mounted on the male connector housing 112, and in this condition the abutment portion 155A of the support piece portion 155 of the slide lock member 113 abuts against the upper surface of the male connector housing 112, and therefore the slide lock member 113 is spaced a predetermined distance from the male connector housing 112. The abutment portion 136A of the elastic member 136 of the slide lock member 113 is held in contact with the support projection 137 of the male connector housing 112 or is slightly pressed against the support projection 137 so that the elastic member 136 produces an urging force for urging the slide lock member 113 in the connector inserting direction.

The front abutment surface 151A of the retaining frame 150 is held in contact with the slanting surfaces 141A of the first guide portions 141 of the male connector housing 112. The slanting surfaces 141A are slanting upwardly in the connector inserting direction, and the front abutment surface 151A is slanting in generally parallel relation to the slanting surfaces 141A, and therefore the downward movement of the slide lock member 113 is limited by the above urging force (Namely, the distal abutment surface 151A slides over the slanting surfaces 141A of the first guide portions 141 in accordance with the downward movement of the slide lock member 113, and at the same time the slide lock member 113 is moved in the connector withdrawing direction. At this time, the elastic member 136 is further elastically deformed, and urges the slide lock member 113 harder to be moved in the connecting inserting direction. This urging force serves to move the slide lock member 113 in the connector inserting direction, and as a result the distal abutment surface 151A tends to slide over the slanting surface 141A so as to push the slide lock member 113 upwardly.). Therefore, the slide lock member 113 is held on the male connector housing 112 in a stable manner.

The second guide portion 143 of the male connector housing 112 is received in the through hole 154 in the slide lock member 113, and a rear abutment surface 143C of the second guide portion 143 abuts against an inner surface 154A of the through hole 154, thereby preventing the slide lock member 113 from being further moved in the connector inserting direction.

As shown in FIG. 15A, the male connector housing 112, having the slide lock member 113 mounted thereon, is inserted into the female connector housing 111. The engagement projection 114, formed on the female connector housing 111, enters the passage hole 115, and the front surface 114A of the engagement projection 114 abuts against the front slanting surface 151A of the retaining frame 150.

When the male connector housing 112 is further inserted as shown in FIG. 15B, the retaining frame 150 is pressed by the engagement projection 114, so that the slide lock member 113 is moved relative to the male connector housing 112 in the connector withdrawing direction. Then, a lower edge of the rear slanting surface 151B of the retaining frame 150 abuts against the slanting surface 143B of the second guide portion 143.

When the male connector housing 112 is further inserted as shown in FIG. 15C, the slide lock member 113 is further moved in the connector withdrawing direction, and the rear slanting surface 151B of the retaining frame 150 slides along the slanting surface 143B of the second guide portion 143, and is slid into the undercut-like notch. As a result, the slide lock member 113 is moved in the connector withdrawing direction, and at the same time the slide lock member 113 is also moved downward toward the male connector housing 112. When the rear slanting surface 151B is completely slid into the undercut-like notch, the abutting engagement of the front slanting surface 151A of the retaining frame 150 with the front surface 114A of the engagement projection 114 is canceled, so that the male connector housing 112 is further inserted into the female connector housing 111, and reaches an engagement position. At this time, the support piece portion 155 is elastically deformed, with its free end raised, and urges the slide lock member 113 upwardly.

When the abutting engagement of the front slanting surface 151A of the retaining frame 150 with the front surface 114A of the engagement projection 114 is canceled, the slide lock member 113 is automatically moved in the connector inserting direction by the urging force of the elastic member 136 as shown in FIG. 15D, so that the front slanting surface 151A of the retaining frame 150 is brought into abutting engagement with the slanting surfaces 141A of the first guide portions 141.

As shown in FIG. 15E, the slanting surface 141A of each first guide portion 141 is slanting upwardly in the connector inserting direction, and when the slide lock member 113 is moved in the connector inserting direction by the urging force of the elastic member 136, the front abutment surface 151A slides over the support surfaces 141A, so that the slide lock member 113 moves upward. In addition, the urging force, produced by a restoring action of the support piece portion 155, acts on the slide lock member 113 so as to urge the slide lock member 113 upwardly, and therefore the slide lock member 113, while moving in the connector inserting direction, moves upward, so that the engagement projection 114 is received in the through hole 154.

In this condition, the engagement projection 114 of the female connector housing 111 is held between the front abutment surface 143A of the second guide portion 143 and the rear slanting surface 151B of the retaining frame 150, and the engagement projection 114 is engaged with the retaining portion 116, thus completing the operation for locking the female and male connector housings 111 and 112 to each other by the slide lock member 113.

When the locking operation is completed, the rear end surface of the male connector housing 112 is disposed flush with the rear end surface of the slide lock member 113, and therefore the completion of the locking operation can be confirmed with the eyes.

For withdrawing the male connector housing 112 from the female connector housing 111, the operating portion 146 of the slide lock member 113 is operated, and the slide lock member 113 is moved in the connector withdrawing direction. Here, the rear slanting surface 151B of the retaining frame 150 and the rear surface 114B of the engagement projection 114 are slanting downwardly in the connector withdrawing direction. Therefore, at this time, the rear slanting surface 151B of the retaining frame 150 slides along the rear surface 114B of the engagement projection 114, so that the slide lock member 113 moves downward. As a result, the engagement of the retaining portion 116 with the engagement projection 114 is canceled (see FIG. 15D), so that the female connector housing 111 and the male connector housing 112 are unlocked relative to each other. When the slide lock member 113 is further moved in the connector withdrawing direction, the inner surface of the receiving portion 148 (to which the elastic member 136 is connected) and the support projection 137 of the male connector housing 112 abut against each other through the pressing portion 136A of the elastic member 136, and the male connector housing 112 is moved together with the slide lock member 113 in the connector withdrawing direction, and is easily withdrawn from the female connector housing 111.

Incidentally, when the male connector housing 112 is operated, the rear slanting surface 151B of the retaining frame 150 slides along the rear surface 114B of the engagement projection 114 so as to move the slide lock member 113 downward. However, the support surfaces 141A abut against the front abutment surface 151A so as to push the slide lock member 113 upward, and therefore the slide lock member 113 can not be moved downward, so that the locked condition of the female and male connectors can not be canceled.

Third Embodiment

Next, a third embodiment of a connector lock structure 201 of the invention will be described in detail with reference to FIGS. 16 and 17. Members and others which are similar in construction and operation to those of the first embodiment will be designated respectively by identical or corresponding reference numerals in the drawings, and explanation thereof will be simplified or omitted.

Figure 16:
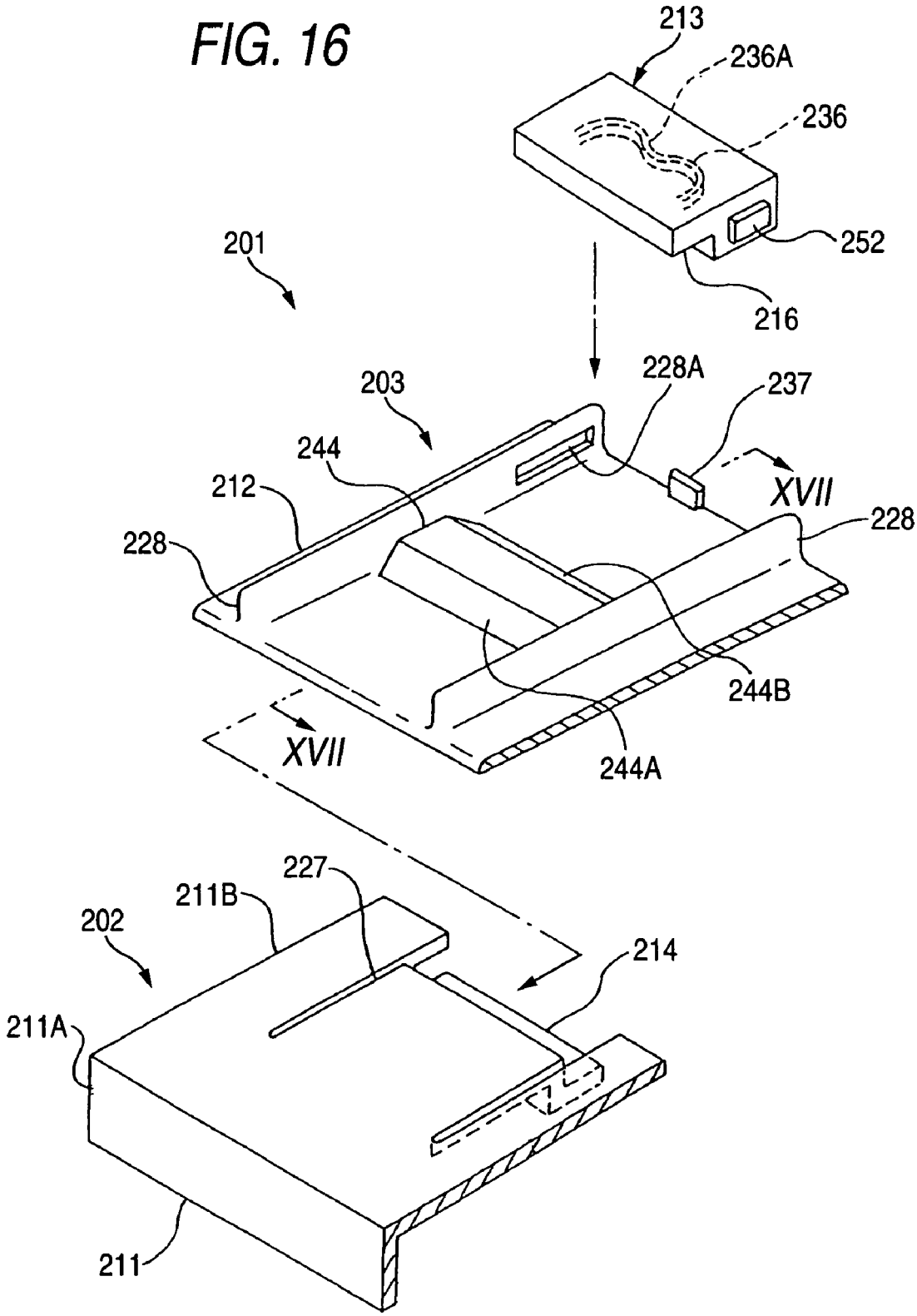
FIG. 16 is a perspective view of a third embodiment of a connector lock structure of the invention.
Figure 17:
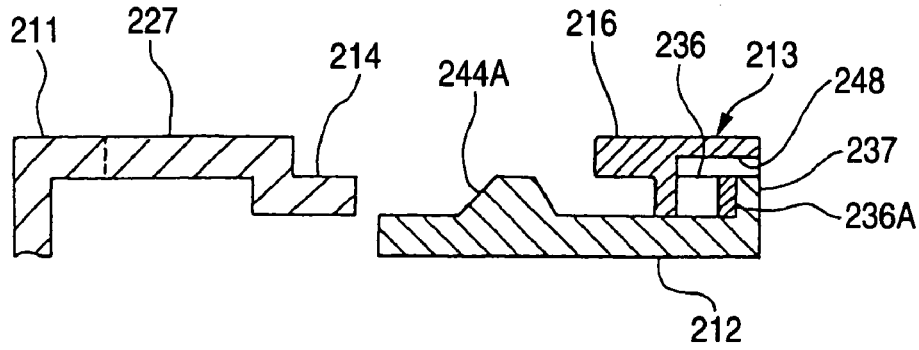
FIGS. 17A to 17C are vertical cross-sectional views showing a locking operation for female and male connectors of FIG. 16.
Figure 17:
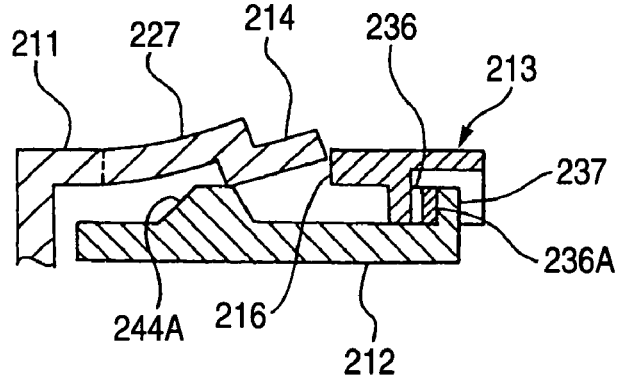
Figure 17:
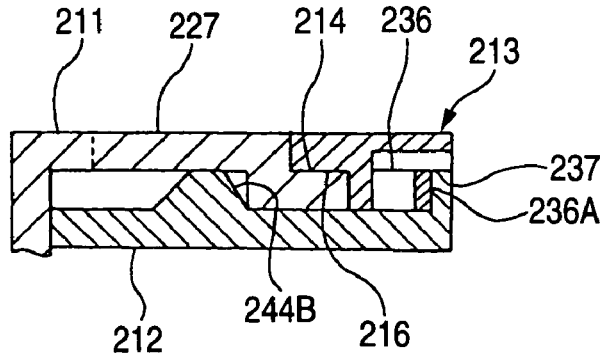

As shown in FIG. 16, when the male connector 203, including a male connector housing 212 receiving a plurality of first terminals (not shown) of one of a male terminal type and a female terminal type, is fitted in the female connector 202 including a female connector housing 211 receiving a plurality of second terminals (not shown) of the other terminal type (for electrical connection to the first terminals), the third embodiment of the connector lock structure 201 of the invention locks the female and male connectors to each other by engaging a retaining portion 216 of a slide lock member 213 (mounted on the male connector housing 212) with an engagement portion 214 formed on the female connector housing 211. The female connector housing 211 is different only in the engagement portion from the female connector housing 11 of the first embodiment, and the other construction is similar to that of the female connector housing 11 of the first embodiment. The male connector housing 212 is different from the male connector housing 12 of the first embodiment only in that a mounting portion for the slide lock member has a different construction, and the other construction is similar to that of the male connector housing 12 of the first embodiment.

A hood portion 211B of the female connector housing 211 has a leg piece portion 227 formed between two slits extending from an open end of the hood portion 211B in a connector inserting/withdrawing direction. The leg piece portion 227 can be elastically deformed upward and downward, with its proximal end (or fixed end connected to the hood portion 211B) serving as a fulcrum. The engagement portion 214 is formed at a free end of the leg piece portion 227. The engagement portion 214 has a generally L-shaped cross-section, and projects into the interior of the hood portion 211B.

A pair of ribs 228 and 228 for forming the mounting portion for the slide lock member 213 are formed on an upper surface of the male connector housing 212. The two ribs 228 are spaced a predetermined distance from each other, and extend in the connector inserting/withdrawing direction. Guide grooves 228A for engagement respectively with guide projections 252 of the slide lock member 213 (described later) are formed respectively in those side surfaces of the two ribs 228 and 228 opposed to each other, and extend in the connector inserting/withdrawing direction. The guide grooves 228A support the slide lock member 213 in such a manner that the slide lock member 213 can be moved in the connector inserting/withdrawing direction.

A convex portion 244 of a generally trapezoidal cross-section is provided at a generally central portion of the mounting portion for the slide lock member 213, and is formed on and projects from an upper surface of the male connector housing 212, and extends in a longitudinal direction of the male connector housing 212. A front slanting surface 244A of the convex portion 244 is slanting upwardly in the connector withdrawing direction, and a rear slanting surface 244B thereof is slanting upwardly in the connector inserting direction.

The slide lock member 213 is formed into a generally rectangular parallelepiped shape, and the guide projections 252 for engagement respectively in the guide grooves 228A (formed respectively in the ribs 228) are formed respectively on opposite side surfaces of the slide lock member.

A notch of a generally rectangular shape is formed in a lower side of a rear end portion of the slide lock member 213 to provide a recess-like receiving portion similar to the receiving portion 48 of the first embodiment. An elastic member 236, serving urging member for urging the slide lock member 213 in the connector inserting direction, is received within this receiving portion.

The elastic member 236 is formed into a generally M-shape as described above for the elastic member 36 of the first embodiment, and opposite ends thereof are integrally connected to an inner surface of the receiving portion. The elastic member 236 is elastically deformed, with its central abutment portion 236A abutting against a support projection 237 of the male connector housing 212, and its restoring action produces an urging force for urging the slide lock member 213 in the connector inserting direction.

The retaining portion 216 is provided at the slide lock member 213, and this retaining portion 216 is formed at an upper portion of a front end of the slide lock member 213, and projects in the connector inserting direction.

Next, the operation for locking the female and male connector housings 211 and 212 to each other by the slide lock member 213 will be described with reference to FIGS. 17A to 17C.

The slide lock member 213 is mounted on the male connector housing 212, and in this condition the male connector housing 212 is inserted into the female connector housing 211 as shown in FIG. 17A. As a result, the engagement portion 214, formed on the female connector housing 211, is inserted between the pair of ribs 228 and 228, and abuts against the front slanting surface 244A of the convex portion 244.

When the male connector housing 212 is further inserted as shown in FIG. 17B, the engagement portion 214 slides along the front slanting surface 244A of the convex portion 244 while elastically deforming the leg piece portion 227, and then slides onto the top of the convex portion 244. In this condition, when the male connector housing 212 is further inserted, the distal end of the engagement portion 214 abuts against the retaining portion 216 of the slide lock member 213, and presses this retaining portion 216. Therefore, the slide lock member 213 is moved relative to the male connector housing 212 in the connector withdrawing direction.

When the male connector housing 212 is further inserted, the engagement portion 214 slides past the convex portion 244, and reaches a position (that is, an engagement position) disposed at the rear side of the convex portion 244. At this time, the engagement of the retaining portion 216 with the distal end of the engagement portion 214 is canceled, and the slide lock member 213 is automatically moved in the connector inserting direction by the urging force of the elastic member 236, so that the retaining portion 216 is superposed on the engagement portion 214. As a result, the engagement portion 214 and the retaining portion 216 are engaged with each other, thus completing the operation for locking the female and male connector housings 211 and 212 to each other by the slide lock member 213.

When the locking operation is completed, the rear end surface of the male connector housing 212 is disposed flush with the rear end surface of the slide lock member 213, and therefore the completion of the locking operation can be confirmed with the eyes.

For withdrawing the male connector housing 212 from the female connector housing 211, the slide lock member 213 is moved in the connector withdrawing direction. As a result, the retaining portion 216 is moved apart from the upper surface of the engagement portion 214, and therefore the engagement of the retaining portion 216 with the engagement portion 214 is canceled, so that the female and male connector housings 211 and 212 are unlocked relative to each other. In this condition, when the slide lock member 213 is further moved in the connector withdrawing direction, the engagement portion 214 slides along the rear slanting surface 244B of the convex portion 244 while elastically deforming the leg piece portion 227, and then slides onto the top of the convex portion 244. Then, the inner surface of the receiving portion (to which the elastic member 236 is connected) and the support projection 237 of the male connector housing 212 abut against each other through the pressing portion 236A of the elastic member 236, and the male connector housing 212 is moved together with the slide lock member 213 in the connector withdrawing direction, and is easily withdrawn from the female connector housing 211.

Incidentally, when the male connector housing 212 is operated, the retaining portion 216 remains on the engagement portion 214, and is held against the engagement portion 214 from the upper side, and therefore the engagement portion 214 can not slide onto the convex portion 244 through the rear slanting surface 244B of the convex portion 244, and therefore the engagement portion 214 abuts against the convex portion 244, so that the locked condition of the female and male connectors can not be canceled.

Fourth Embodiment

Next, a fourth embodiment of a connector lock structure 301 of the invention will be described in detail with reference to FIGS. 18 to 22. Members and others which are similar in construction and operation to those of the first embodiment will be designated respectively by identical or corresponding reference numerals in the drawings, and explanation thereof will be simplified or omitted.

Figure 18:
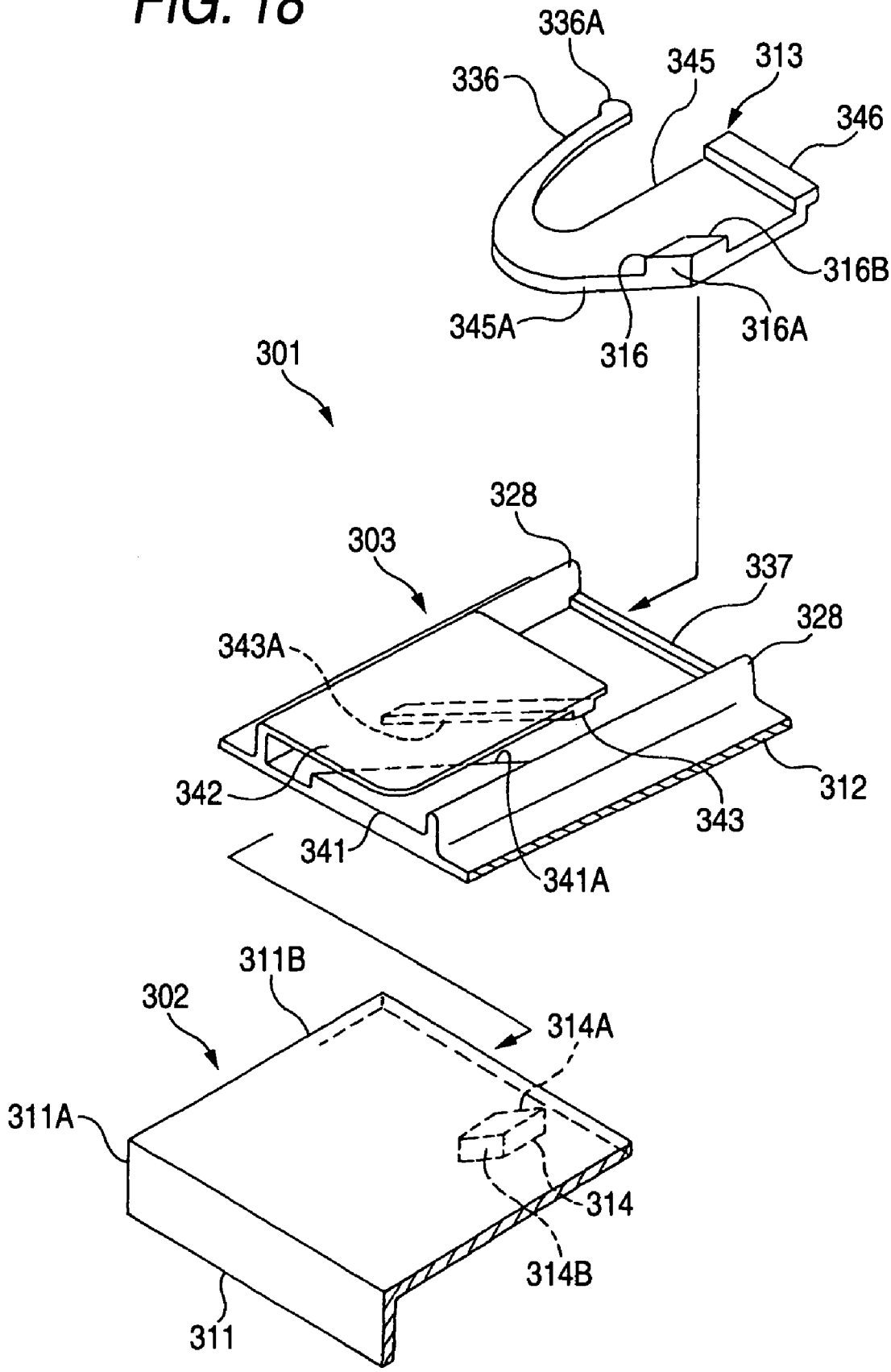
FIG. 18 is an exploded, perspective view of a fourth embodiment of a connector lock structure of the invention.
Figure 22:
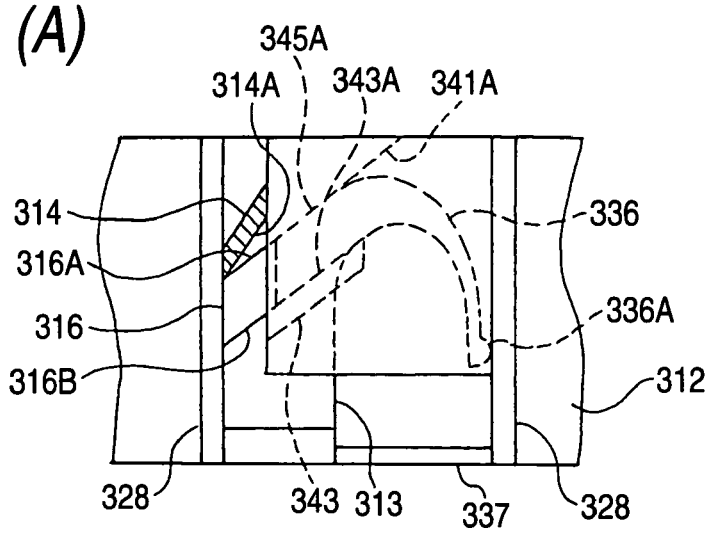
FIGS. 22A to 22C are horizontal cross-sectional views showing a locking operation for the female and male connectors of FIG. 18.
Figure 22:
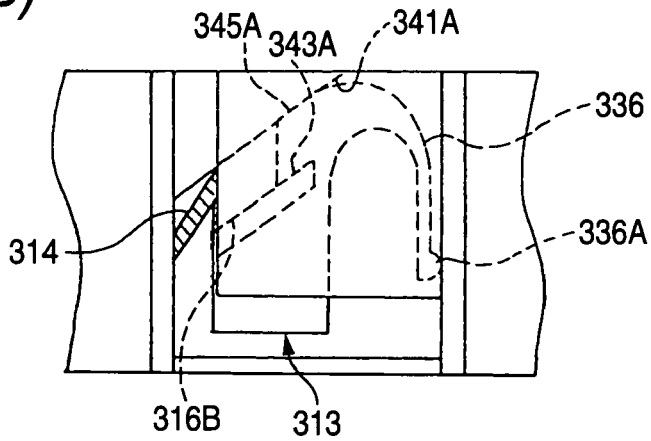
Figure 22:
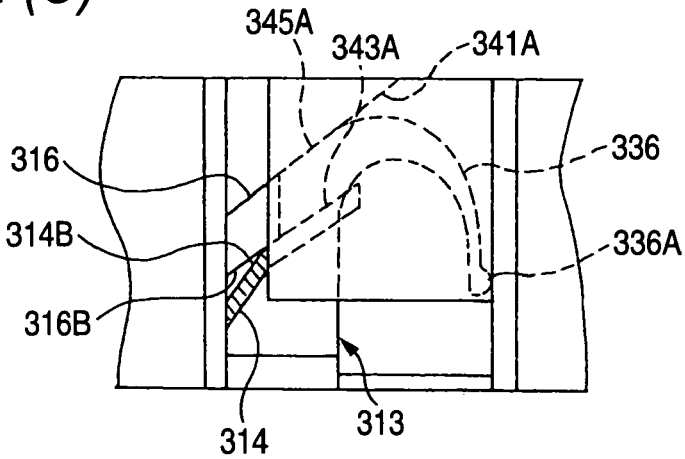

As shown in FIGS. 18 and 22, when the male connector 303, including a male connector housing 312 receiving a plurality of first terminals (not shown) of one of a male terminal type and a female terminal type, is fitted in the female connector 302 including a female connector housing 311 receiving a plurality of second terminals (not shown) of the other terminal type (for electrical connection to the first terminals), the third embodiment of the connector lock structure 301 of the invention locks the female and male connectors to each other by engaging a retaining portion 316 of a slide lock member 313 (mounted on the male connector housing 312) with an engagement projection (engagement portion) 314 formed on the female connector housing 311. The female connector housing 311 is different only in the engagement portion from the female connector housing 11 of the first embodiment, and the other construction is similar to that of the female connector housing 11 of the first embodiment. The male connector housing 312 is different from the male connector housing 12 of the first embodiment only in that a mounting portion for the slide lock member has a different construction, and the other construction is similar to that of the male connector housing 12 of the first embodiment.

A receiving portion for receiving the slide lock member 313 (described later) is formed at a generally central portion of an upper inner surface of a hood portion 311B of the female connector housing 311, and the engagement projection 314 in the form of a pillar of a generally rectangular cross-section is formed in a projecting manner at this receiving portion. A front surface 314A of the engagement projection 314, directed to an open end of the hood portion 311B, is inclining rearwardly in a connecting inserting direction, and a front end portion of the engagement projection 314 is tapering into an acute angle.

A pair of ribs 328 and 328 for forming the mounting portion for the slide lock member 313 are formed on an upper surface of the male connector housing 312. The two ribs 328 are spaced a predetermined distance from each other, and extend in the connector inserting/withdrawing direction. A first guide portion 341 for guiding the movement of the slide lock member 313 is formed at a front (in the connector inserting direction) portion of the mounting portion for the slide lock member 313, and an inclining surface 341A is inclining rearwardly in the connector inserting direction.

Figure 19:
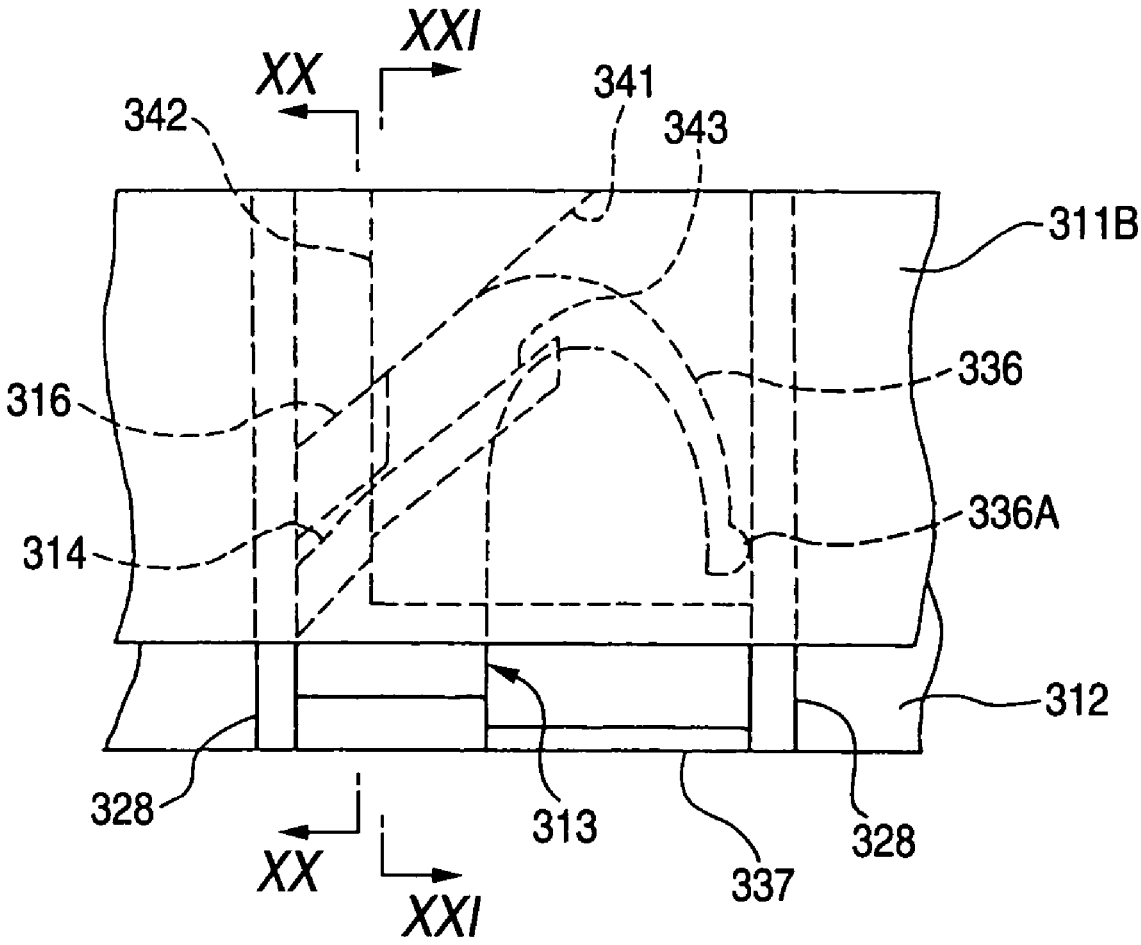
FIG. 19 is a plan view showing an important portion of female and male connectors of FIG. 18, showing their locked condition.
Figure 20:
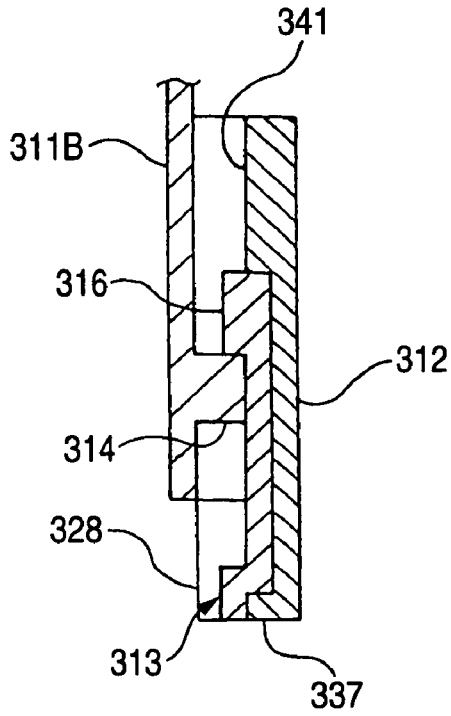
FIG. 20 is a cross-sectional view taken along the line XX-XX of FIG. 19.
Figure 21:
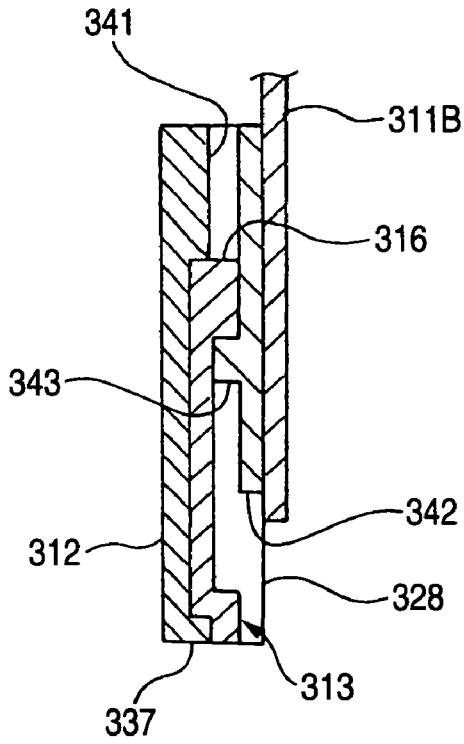
FIG. 21 is a cross-sectional view taken along the line XXI-XXI of FIG. 19.

A generally-rectangular plate-like cover 342 is disposed above the first guide portion 314, and is spaced a predetermined distance therefrom, and the cover 342 extends from one rib 328. A second guide portion 343 for guiding the movement of the slide lock member 313 is formed on and projects from a lower surface of the cover 342 (which is opposed to an upper surface of the male connector housing 312). The second guide portion 343 has an inclining surface 343A disposed parallel to the inclining surface 341A of the first guide portion 341. As shown in FIG. 19, the inclining surface 341A of the first guide portion 341 and the inclining surface 343A of the second guide portion 343 are spaced a predetermined distance from each other in the connector inserting direction, and the retaining portion 316 of the slide lock member 313 (described later) is to be disposed therebetween. The cover 342 cooperates with the other rib 328 to form an entry passageway which the engagement projection 314 is allowed to enter.

The slide lock member 313 includes a generally-rectangular plate-like body 345, and an elastic member 336 serving as urging member. The elastic member 336 extends laterally from one corner portion of a front end of the body 345, and extends in the connector withdrawing direction through a curved portion. The elastic member 336 can be elastically deformed in such a manner that a pressing portion 336A, formed at a distal end thereof, is moved toward the body 345.

An inclining surface 345A, disposed parallel to the inclining surface 341A of the first guide portion 341, is formed at the other corner portion of the front end of the body 345 remote from the elastic member 336. The retaining portion 316 in the form of a pillar of a generally rhombic cross-section is formed on and projects from an upper surface of the body 345. The retaining portion 316 includes a front surface 316A and a rear surface 316B which are parallel to the inclining surface 345A, and opposite side surfaces extending in a direction parallel to the connector inserting direction.

Next, the operation for locking the female and male connector housings 311 and 312 to each other by the slide lock member 313 will be described with reference to FIGS. 22A to 22C.

When the slide lock member 313 is mounted on the male connector housing 311 (that is, set in a standby position), the pressing portion 336A, formed at the distal end of the elastic member 336, is held against the one rib 328, and when the slide lock member 313 is moved, the elastic member 336 is elastically deformed to store a resilient force which serves as an urging force for urging the slide lock member 313 toward the other rib 328.

When the male connector housing 312 is inserted into the female connector housing 311 as shown in FIG. 22A, the engagement projection 314, formed on the female connector housing 311, advances through the entry passage formed between the rib 328 and the cover 342, and the front end portion (formed into the acute angle) of the engagement projection 314 is introduced between the front surface 316A of the retaining portion 316 (formed on the slide lock member 313) and the rib 328.

As shown in FIG. 22B, the front surface 314A of the engagement projection 314 is more inclined than the inclining surface 343A of the second guide portion 343, and therefore the retaining portion 316 slides along the inclination of the front surface 314A of the engagement projection 314 to be moved laterally, and at the same time slides along the inclination surface 343A to be moved in the connector inserting direction. As a result, the slide lock member 313, while elastically deforming the elastic member 336, is moved obliquely forwardly relative to the connector inserting direction.

When the male connector housing 312 is further inserted into the female connector housing 311 as shown in FIG. 22C, the engagement projection 314 reaches the engagement position where it is engaged with the retaining portion 316, and the abutting engagement of the engagement projection 314 and the retaining portion 316 with each other at their side surfaces is canceled. The slide lock member 313 is returned laterally by the urging force of the elastic member 336, and at the same time the inclining surface 345A of the body 345 slides along the first guide portion 341A, so that the slide lock member 313 is moved also in the connector withdrawing direction. As a result, the slide lock member 313 is returned to the above standby position. At this time, the retaining portion 316 is disposed at the rear side of the engagement projection 314, and the engagement projection 314 and the retaining portion 316 are engaged with each other, thus completing the operation for locking the female and male connector housings 311 and 312 to each other by the slide lock member 313.

For withdrawing the male connector housing 312 from the female connector housing 311, the slide lock member 313 is moved in the connector inserting direction. At this time, the inclining surface 345A of the body 345 of the slide lock member 313 slides along the inclining surface 341A of the first guide portion 341, and the slide lock member 313 moves obliquely forwardly relative to the connector inserting direction. As a result, the retaining portion 316 moves from the rear side of the engagement projection 314, so that the engagement of the retaining portion 316 with the engagement projection 314 is canceled, thus unlocking the female and male connector housings 311 and 312 relative to each other. In this condition, the male housing 312 is withdrawn to be disengaged from the female connector housing 311.

Incidentally, when the slide lock member 313 is to be moved in the connector inserting direction, a rear end portion of an operating portion 346 is pressed by the finger, and the finger is engaged with an exposed support projection 337, and in this condition the male connector housing 312 can be withdrawn, and therefore the male connector housing 312 can be easily withdrawn from the female connector housing 311.

The connector lock structures of the present invention are not limited to the above embodiment, and suitable modifications, improvements and so on can be made. For example, with respect to the number of the first terminals (received in the male connector housing) and the number of the second terminals received in the female connector housing, any number is acceptable in so far as at least one terminal is received in each connector housing, and the plurality of terminals can be arranged in a plurality of rows in the vertical direction.

In each of the above embodiments, although the elastic member, serving as the urging member, is formed integrally with the slide lock member, by injection molding of a synthetic resin, the material is not limited to such a synthetic resin. For example, the elastic member can be made of a metallic material, in which case the elastic member is integrally connected to the slide lock member by insert molding or the like.

What is claimed is:

1. A connector lock structure provided at a pair of female and male connectors which can be fitted together, comprising:

an engagement portion, having a guide lock plate and a partition wall connected to the guide lock plate by an incline surface, formed on one of said female and male connectors; and a slide lock member supported on the other of said female and male connectors so as to move at least in connector-inserting and connector-withdrawing directions, a retaining portion, provided with said slide lock member, engagement with said engagement portion; and an urging member provided on said slide lock member for urging said slide lock member forwardly, wherein when said engagement portion reaches an engagement position where said partition wall of said engagement portion is engaged with said retaining portion at the time when said female and male connectors are completely fitted together, said slide lock member is thereafter automatically moved by said urging member, so that said retaining portion is engaged with said guide lock plate of said engagement portion.

2. A connector lock structure according to claim 1, wherein the engagement of said retaining portion with said engagement portion is canceled by operating said slide lock member in one of the connector-inserting and connector-withdrawing directions.

3. A connector lock structure according to claim 1, wherein said urging member includes an elastic member; and wherein said female and male connectors are moved relative to each other so as to be fitted together, said engagement portion and said retaining portion are brought into abutting engagement with each other, so that said slide lock member is moved to elastically deforming said elastic member.

4. A connector lock structure according to claim 1, wherein said male connector includes a male connector housing, wherein said slide lock member is mounted on an outer surface of said male connector housing, wherein said female connector includes a female connector housing, wherein said female connector housing includes a hood portion, and said male connector housing can be inserted into and withdrawn from said hood portion, and wherein said engagement portion is formed in a projecting manner within said hood portion.

5. A connector lock structure according to claim 4, wherein said retaining portion includes a pair of retaining piece portions which are spaced a predetermined distance from each other, and extend in the connector inserting direction in parallel relation to each other, and the distance between distal end portions of said pair of retaining piece portions is reduced, wherein said female and male connectors are moved relative to each other so as to be fitted together, said engagement portion is inserted between the distal end portions of said pair of retaining piece portions to increase the distance between said distal end portions, and reaches said engagement position, and wherein said slide lock member is moved in the connector inserting direction by said urging member, so that said engagement portion is received between said pair of retaining piece portions.

6. A connector lock structure according to claim 5, wherein when said slide lock member is moved by said urging member, the distal end portions of said pair of retaining piece portions are moved toward each other.

* * * * *